US009302299B2

(12) United States Patent
Prahlad et al.

(10) Patent No.: US 9,302,299 B2
(45) Date of Patent: Apr. 5, 2016

(54) ACTIVE ELECTROADHESIVE CLEANING

(71) Applicant: SRI International, Menlo Park, CA (US)

(72) Inventors: Harsha Prahlad, Cupertino, CA (US); Ronald E. Pelrine, Longmont, CO (US); Philip A. Von Guggenberg, Redwood City, CA (US); Roy D. Kornbluh, Palo Alto, CA (US); Brian K. McCoy, Sunnyvale, CA (US); Youssef Iguider, Tokyo (JP)

(73) Assignee: SRI International, Menlo Park, CA (US)

( * ) Notice: Subject to any disclaimer, the term of this patent is extended or adjusted under 35 U.S.C. 154(b) by 0 days.

(21) Appl. No.: 14/834,032

(22) Filed: Aug. 24, 2015

(65) Prior Publication Data

US 2015/0360264 A1 Dec. 17, 2015

Related U.S. Application Data

(63) Continuation of application No. 14/004,726, filed as application No. PCT/US2012/030454 on Mar. 23, 2012, now Pat. No. 9,186,709.

(60) Provisional application No. 61/466,907, filed on Mar. 23, 2011.

(51) Int. Cl.
*B08B 1/00* (2006.01)
*B08B 6/00* (2006.01)
(Continued)

(52) U.S. Cl.
CPC . *B08B 6/00* (2013.01); *A47L 13/40* (2013.01); *A47L 25/005* (2013.01); *B03C 7/023* (2013.01); *B08B 7/00* (2013.01)

(58) Field of Classification Search
CPC ..... B08B 6/00; B08B 7/00; A47L 13/40; A47L 25/005; B03C 7/023
See application file for complete search history.

(56) References Cited

U.S. PATENT DOCUMENTS 3,536,528 A 10/1970 De Geest
3,684,575 A 8/1972 King
(Continued)

FOREIGN PATENT DOCUMENTS

BE 901726 5/1985
DE 202005019251 3/2006
(Continued)

OTHER PUBLICATIONS

European Patent Office, Extended European Search Report, European Patent Application No. 12761130.9, dated Sep. 9, 2014, 11 pages.
(Continued)

*Primary Examiner* — Bibi Carrillo
(74) *Attorney, Agent, or Firm* — McDonnell Boehnen Hulbert & Berghoff LLP

(57) ABSTRACT

An active electroadhesive cleaning device or system includes electrode(s) that produce electroadhesive forces from an input voltage to adhere dust or other foreign objects against an interactive surface, from which the foreign objects are removed when the forces are controllably altered. User inputs control the input voltage and/or designate the size of foreign objects to be cleaned. An active power source provides the input voltage, and the interactive surface can be a continuous track across one or more rollers to move the device across a dirty foreign surface. Electrodes can be arranged in an interdigitated pattern having differing pitches that can be actuated selectively to clean foreign objects of different sizes. Sensors can detect the amount of foreign particles adhered to the interactive surface, and reversed polarity pulses can help repel items away from the interactive surface in a timely and controlled manner.

6 Claims, 12 Drawing Sheets

(51) Int. Cl.

| | |
|---|---|
| ***A47L 25/00*** | (2006.01) |
| ***A47L 13/40*** | (2006.01) |
| ***B03C 7/02*** | (2006.01) |
| *B08B 7/00* | (2006.01) |

(56) References Cited

U.S. PATENT DOCUMENTS

| | | | | |
|---|---|---|---|---|
| 4,962,727 | A | 10/1990 | Harada | |
| 4,996,078 | A | 2/1991 | Langowski | |
| 5,000,203 | A * | 3/1991 | Hamada | B03C 1/00 134/1 |
| 5,229,170 | A | 7/1993 | Narusawa | |
| 6,799,350 | B1 | 10/2004 | Gordon | |
| 7,551,419 | B2 | 6/2009 | Pelrine et al. | |
| 7,554,787 | B2 | 6/2009 | Pelrine et al. | |
| 7,782,591 | B2 | 8/2010 | Cho et al. | |
| 9,186,709 | B2 | 11/2015 | Prahlad et al. | |
| 2004/0163667 | A1 | 8/2004 | Learman | |
| 2005/0059239 | A1 | 3/2005 | Goto | |
| 2008/0089002 | A1 | 4/2008 | Pelrine et al. | |
| 2010/0154821 | A1 | 6/2010 | Moriya et al. | |
| 2010/0307342 | A1 | 12/2010 | Gibis et al. | |
| 2013/0276826 | A1 | 10/2013 | Koenig et al. | |
| 2014/0064905 | A1 | 3/2014 | Prahlad et al. | |
| 2014/0104744 | A1 | 4/2014 | Prahlad et al. | |
| 2014/0133062 | A1 | 5/2014 | Prahlad et al. | |

FOREIGN PATENT DOCUMENTS

| | | |
|---|---|---|
| DE | 102008008576 | 8/2009 |
| EP | 0401489 | 12/1990 |
| EP | 1852192 | 7/2007 |
| EP | 1974644 | 10/2008 |
| EP | 1985432 | 10/2008 |
| JP | S61-71433 | 5/1986 |
| JP | H05-285084 | 2/1993 |
| JP | H09-131290 | 5/1997 |
| JP | H11-56731 | 3/1999 |
| JP | 2003-225625 | 8/2003 |
| JP | 2009-226310 | 10/2009 |
| KR | 2010-0025814 | 3/2010 |
| WO | 2005/117679 | 12/2005 |
| WO | 2007/143662 | 12/2007 |
| WO | 2008/070201 | 6/2008 |
| WO | 2009/100744 | 8/2009 |
| WO | WO2012129541 A2 * | 9/2012 |
| WO | WO2013188420 A1 * | 12/2013 |

OTHER PUBLICATIONS

International Searching Authority, International Search Report and Written Opinion for International Application No. PCT/US2012/030454, mailed Oct. 29, 2012, 9 pages.

International Searching Authority, International Search Report and Written Opinion for International Application No. PCT/US2013/045200, mailed Oct. 2, 2013, 8 pages.

Japanese Patent Office, Notification of Reason(s) for Rejection, Japanese Patent Application No. 2014-501289, dated Nov. 20, 2014, 8 pages.

* cited by examiner

ACTIVE ELECTROADHESIVE CLEANING

CROSS-REFERENCE TO RELATED APPLICATION

This application is a continuation of U.S. patent application Ser. No. 14/004,726, filed Nov. 6, 2013, now U.S. Pat. No. 9,186,709, which claims priority to U.S. Provisional Patent Application No. 61/466,907, filed Mar. 23, 2011, entitled "ELECTROADHESIVE CLEANING—METHOD AND APPARATUS," which applications are incorporated by reference herein in their entirety and for all purposes.

TECHNICAL FIELD

The present invention relates generally to electroadhesion and other electrostatic applications, and more particularly to the use of electroadhesion to clean or otherwise handle foreign objects.

BACKGROUND

Cleaning devices such as wipes, sponges, brushes, brooms, mops, dusters, vacuum cleaners and the like are generally well known and widely used to clean floors and surfaces in all sorts of home, commercial and industrial environments. Such devices can be used to clean in both indoor and outdoor settings, with further traditionally outdoor devices such as rakes, mowers, blowers and the like having various applications across numerous other settings as well. Many of these devices and tools require a significant amount of manual labor to be useful, such that a wide variety powered implementations, features and other improvements have been provided for many such cleaning devices over the years to help users in this regard.

Some provided features that have been useful for various cleaning devices have involved the use of static electricity. Static or electrostatic dusters, for example, are well known devices that utilize small electrical charges to help remove dust and other small particles in household and other indoor cleaning applications. Such small electrical charges are typically generated by way of thousands of fine fibers or hairs that brush up against or otherwise move along a surface of another object, such as the object being cleaned. While such applications can be favorable with respect to dust and other small particles, the small electrostatic forces generated by such electrostatic dusters are often insufficient to clean or otherwise remove larger particles items. Of course, the use of significantly larger electrical forces would then tend to present safety issues that would need to be addressed.

Unfortunately, the traditional use of small electrostatic forces in dusting or cleaning applications can also have additional drawbacks, such as a lack of control over the electrostatic forces, an inability to distinguish between different particles or objects being cleaned, and a tendency for the electrically charged components to be difficult or more time consuming to clean or otherwise maintain. This last drawback can often result in the need to replace components or devices more often, which can add significantly to the overall cost of use for such devices.

Although many cleaning devices and methods have generally worked well in the past, there is always a desire for improvement. In particular, what is desired are cleaning devices and methods that are able to utilize greater electrical forces that can clean a greater variety of items in a controlled, safe and more discriminating manner.

SUMMARY

It is an advantage of the present invention to provide improved cleaning devices and methods that enable better cleaning in less time and with reduced amounts of associated manual labor. Such improved devices and methods preferably are able to utilize greater electrical forces that can clean a greater variety of items in a controlled, safe and more discriminating manner. In particular, the controlled use of active electroadhesion can facilitate improved cleaning for such devices and methods.

In various embodiments of the present invention, an active electroadhesive cleaning device or system can be adapted to clean one or more foreign objects, such as away from a dirty region. The device or system can include one or more electrodes adapted to produce one or more electroadhesive forces from an input voltage, one or more input components adapted to accept and facilitate user input to control the input voltage, and at least one interactive surface positioned proximate and/or distal to the electrode(s) and configured to interact with one or more foreign objects to be cleaned. A separate respective electroadhesive force can be generated for each foreign object to be cleaned, and each such electroadhesive force can suitably adhere its respective foreign object to the interactive surface or elsewhere on the cleaning device. The interactive surface or surfaces can be arranged to permit the passage of the electroadhesive force(s) therethrough, such that the foreign object(s) are adhered thereagainst. In addition, the interactive surface(s) can be further adapted to facilitate the ready removal of the foreign object(s) therefrom, such as when the electroadhesive force(s) are controllably altered. Such altering can be a reduction, removal or reversal of the electroadhesive force(s). The foreign object(s) can also be physically removed without necessarily altering the electroadhesive force(s), such as by using mechanical forces such as those provided by a dust brush in contact with the interactive surface(s), a non-contact electrostatic plate that attracts dust away from the interactive surface onto itself, a fluid jet that washes or blows away items, or a localized vacuum that pulls dust away from the interactive surface, for example.

In various detailed embodiments, the foreign object(s) can include dust, dirt, pebbles, crumbs, hair, garbage and/or other particulate matter to be cleaned. In some embodiments, the interactive surface can include a plurality of cilia, a plurality of flaps, one or more light adhesives, and/or any of a variety of materials, such as soft, tacky, fabric, fiber, cloth, plastic and/or other suitable materials. In some embodiments, at least a portion of the interactive surface can comprise a deformable surface, such that a respective portion of the deformable surface moves closer to at least one of the foreign objects when the electroadhesive force is applied.

In various embodiments, the active electroadhesive cleaning device or system can include an active power source coupled to one or more input components and one or more electrodes, wherein the active power source is preferably adapted to facilitate providing the input voltage to the one or more electrodes. In addition, some embodiments can include one or more rollers coupled to the interactive surface and operable to move the active electroadhesive device or system across a foreign surface upon which the foreign object(s) to be cleaned are located. In such arrangements, the interactive surface(s) can be configured as a continuous track that moves with respect to a rotational motion of the one or more rollers.

In some embodiments, a removal component or components can be adapted to facilitate the removal of the one or more foreign objects from the interactive surface after the one or more foreign objects have been displaced from the dirty region. For such a removal component, for example, the electrode(s) can be further adapted to produce collectively one or more reverse polarity pulses, such that one or more repellant forces suitably repel one or more foreign objects away from the active electroadhesive cleaning device when the charges are controllable reversed.

In some detailed embodiments, the electrodes can include a plurality of oppositely chargeable electrodes arranged into a pattern. Such a pattern can involve an interdigitated pattern or portion having a plurality of differing pitches. Such differing pitches can be adapted to clean foreign objects of correspondingly different sizes, and the interdigitated electrode pattern can be operable to actuate the plurality of differing pitches selectively. In this manner, the size of the foreign objects to be cleaned can be designated, such as by a user input. In some embodiments, one or more sensors can be coupled to the interactive surface and adapted to detect the amount of foreign objects adhered thereto. Such sensors can be used to aid in the removal of particular matter from the interactive surface in some cases. Alternatively, or in addition, such sensors can indicate to the user that it is time for thorough cleaning or replacement of the interactive surface(s).

In still further detailed embodiments, the device or system can include an ion charge sprayer positioned proximate the interactive surface and adapted to spray a plurality of ionic charges onto the foreign object(s), such that at least a portion of the respective electroadhesive force(s) result from the presence of the ionic charges on the foreign object(s). In such embodiments, exactly one electrode can be used, with that exactly one electrode being adapted to carry a charge of the opposite polarity from the plurality of ionic charges.

In still further embodiments, various methods of physically cleaning one or more foreign objects are provided. Such methods can involve cleaning a plurality of foreign objects away from a dirty region, for example. Process steps can include contacting an interactive surface to each of a plurality of foreign objects situated about the dirty surface, applying an electrostatic adhesion voltage in a controlled manner across one or more electrodes located proximate the interactive surface, adhering each of the plurality of foreign objects to the interactive surface via respective electrostatic attraction forces, moving the interactive surface away from the dirty surface while the plurality of foreign objects remain adhered thereto, altering the electrostatic adhesion voltage in a controlled manner, and removing the plurality of foreign objects from the interactive surface after the electrostatic adhesion voltage has been altered. Similar to the foregoing, the electrostatic adhesion voltage is preferably sufficient to generate a separate respective electrostatic attraction force through at least a portion of the interactive surface with respect to each of the plurality of foreign objects situated about the dirty surface. In some embodiments, the dirty surface can be the ground, floor, a wall or another other relevant surface to be cleaned. In some embodiments, the step of altering the electrostatic adhesion voltage can include reversing the polarity of the voltage. Such a feature can result in repelling the foreign object(s) away from the interactive surface in a controlled manner at a desired time.

Other apparatuses, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and arrangements for the disclosed inventive active electroadhesive cleaning devices, systems and methods. These drawings in no way limit any changes in form and detail that may be made to the invention by one skilled in the art without departing from the spirit and scope of the invention.

DETAILED DESCRIPTION

Figure 1A:
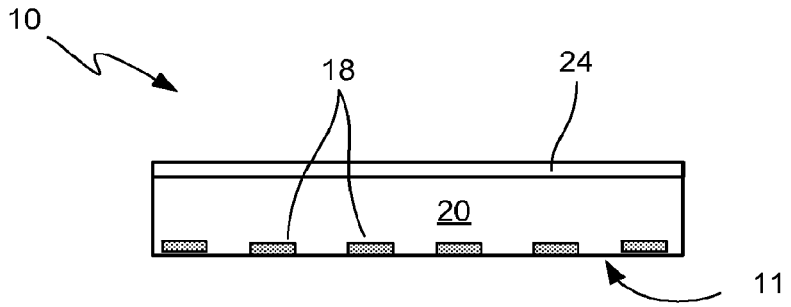
FIG. 1A illustrates in side cross-sectional view an exemplary electroadhesive device.

Exemplary applications of apparatuses and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as limiting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used, and changes may be made without departing from the spirit and scope of the invention.

The present invention relates in various embodiments to devices, systems and methods involving active electrostatic cleaning applications. In various particular embodiments, the subject cleaning devices, systems or methods can utilize an active electroadhesion component that includes an actual power source and one or more electrodes that are arranged to generate specific and controllable electroadhesive forces with respect to one or more particles or other foreign objects to be cleaned. It will be understood that the term "active" generally refers to a more controlled, power source based, and/or more powerful/higher charge application of electroadhesion and electrostatic principles, in contrast with the generally uncontrolled and typically low charge nature of electrostatic cling that is inherently generated by and featured in traditional electrostatic dusters and other similar items.

While the various examples disclosed herein focus on particular aspects of specific electroadhesive applications, it will be understood that the various inventive principles and embodiments disclosed herein can be applied to other electrostatic applications and arrangements as well. For example, an electrolaminate application involving one or more electrostatically charged sheets can utilize the same types of electrodes and general electrostatic principles for cleaning and otherwise controlling particles and other foreign objects. Furthermore, while the particular applications described herein are made with respect to cleaning or handling particles and other items by way of electroadhesive forces, it will be readily appreciated that the various electrodes and materials therefore provided herein can be used in a variety of other applications that are not necessarily restricted to such environments.

In providing various details for the contemplated embodiments, the following disclosure provides an initial discussion regarding electroadhesion, followed by a brief description of electrostatic properties, and then various details regarding active electroadhesive cleaning devices and methods. A particular method of operating an active electroadhesive cleaning system is then provided.

Electroadhesion

As the term is used herein, "electroadhesion" refers to the mechanical coupling of two objects using electrostatic forces. Electroadhesion as described herein uses electrical control of these electrostatic forces to permit temporary and detachable attachment between two objects. This electrostatic adhesion holds two surfaces of these objects together or increases the traction or friction between two surfaces due to electrostatic forces created by an applied electrical field. Although electrostatic clamping has traditionally been limited to holding two flat, smooth and generally conductive surfaces separated by a highly insulating material together, the various embodiments provided herein can involve electroadhesion devices and techniques that do not limit the material properties, curvatures, size or surface roughness of the objects subject to electroadhesive forces and handling. Furthermore, while the various examples and discussions provided herein typically involve electrostatically adhering a particle or other foreign item to a cleaning device, it will also be understood that many other types of electrostatic applications may also generally be implicated for use with the disclosed embodiments. For example, two components of the same device may be electrostatically adhered to each other, such as in an electrolaminate or other type of arrangement.

Turning first to FIG. 1A, an exemplary electroadhesive device is illustrated in elevated cross-sectional view. Electroadhesive device 10 includes one or more electrodes 18 located at or near an "electroadhesive gripping surface" 11 thereof, as well as an insulating material 20 between electrodes 18 and a backing 24 or other supporting structural component. For purposes of illustration, electroadhesive device 10 is shown as having six electrodes in three pairs, although it will be readily appreciated that more or fewer electrodes can be used in a given electroadhesive device. Where only a single electrode is used in a given electroadhesive device, a complimentary electroadhesive device having at least one electrode of the opposite polarity is preferably used therewith. With respect to size, electroadhesive device 10 is substantially scale invariant. That is, electroadhesive device sizes may range from less than 1 square centimeter to greater than several meters in surface area. Even larger and smaller surface areas also possible, and may be sized to the needs of a given application.

Figure 1B:
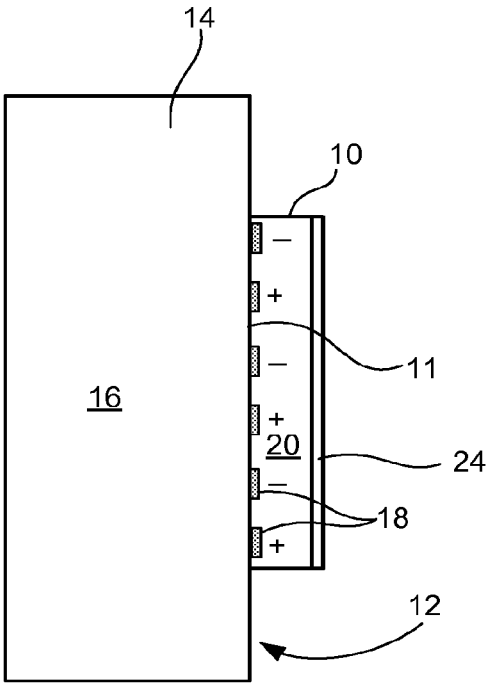
FIG. 1B illustrates in side cross-sectional view the exemplary electroadhesive device of FIG. 1A adhered to a foreign object.

FIG. 1B depicts in elevated cross-sectional view the exemplary electroadhesive device 10 of FIG. 1A adhered to a foreign object 14. Foreign object 14 includes surface 12 and inner material 16. Electro adhesive gripping surface 11 of electroadhesive device 10 is placed against or nearby surface 12 of foreign object 14. An electrostatic adhesion voltage is then applied via electrodes 18 using external control electronics (not shown) in electrical communication with the electrodes 18. As shown in FIG. 1B, the electrostatic adhesion voltage uses alternating positive and negative charges on neighboring electrodes 18. As result of the voltage difference between electrodes 18, one or more electroadhesive forces are generated, which electroadhesive forces act to hold the electroadhesive device 10 and foreign object 14 against each other. Due to the nature of the forces being applied, it will be readily appreciated that actual contact between electroadhesive device 10 and foreign object 14 is not necessary. For example, a piece of paper, thin film, or other material or substrate may be placed between electroadhesive device 10 and foreign object 14. Furthermore, although the term "contact" is used herein to denote the interaction between an electroadhesive device and a foreign object, it will be understood that actual direct surface to surface contact is not always required, such that one or more thin objects such as an insulator, can be disposed between an electroadhesive gripping surface and the foreign object. In some embodiments such an insulator between the gripping surface and foreign object can be a part of the device, while in others it can be a separate item or device.

Figure 1C:
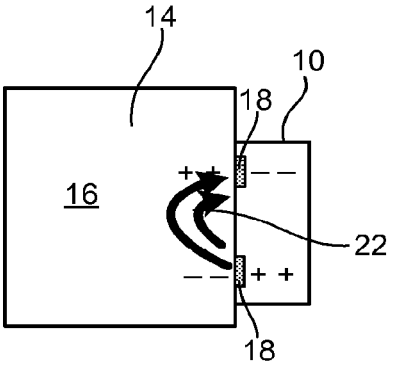
FIG. 1C illustrates in side cross-sectional close-up view an electric field formed in the foreign object of FIG. 1B as result of the voltage difference between electrodes in the adhered exemplary electroadhesive device.

FIG. 1C illustrates in elevated cross-sectional close-up view an electric field formed in the foreign object of FIG. 1B as result of the voltage difference between electrodes in the adhered exemplary electroadhesive device 10. While the electroadhesive device 10 is placed against foreign object 14 and an electrostatic adhesion voltage is applied, an electric field 22 forms in the inner material 16 of the foreign object 14. The electric field 22 locally polarizes inner material 16 or induces direct charges on material 16 locally opposite to the charge on the electrodes 18 of the device, and thus causes electrostatic adhesion between the electrodes 18 (and overall device 10) and the induced charges on the foreign object 14. The induced charges may be the result of a dielectric polarization or from weakly conductive materials and electrostatic induction of charge. In the event that the inner material 16 is a strong conductor, such as copper for example, the induced charges may completely cancel the electric field 22. In this case the internal electric field 22 is zero, but the induced charges nonetheless still form and provide electrostatic force to the device 10. Again, an insulator may also be provided between the device 10 and foreign object 14 in instances where material 16 is copper or another strong conductor.

Thus, the electrostatic adhesion voltage provides an overall electrostatic force, between the electroadhesive device 10 and inner material 16 beneath surface 12 of foreign object 14, which electrostatic force maintains the current position of the electroadhesive device relative to the surface of the foreign object. The overall electrostatic force may be sufficient to overcome the gravitational pull on the foreign object 14, such that the electroadhesive device 10 may be used to hold the foreign object aloft. In various embodiments, a plurality of electroadhesive devices may be placed against foreign object 14, such that additional electrostatic forces against the object can be provided. Furthermore, the foreign object need not be larger than the electroadhesive device in all or any dimension, and it is specifically contemplated that the foreign object can be significantly smaller than the electroadhesive device in some embodiments. The combination of electrostatic forces may be sufficient to lift, move, pick and place, or otherwise handle the foreign object. Electroadhesive device 10 may also be attached to other structures and hold these additional structures aloft, or it may be used on sloped or slippery surfaces to increase normal friction forces Removal of the electrostatic adhesion voltages from electrodes 18 ceases the electrostatic adhesion force between electroadhesive device 10 and the surface 12 of foreign object 14. Thus, when there is no electrostatic adhesion voltage between electrodes 18, electroadhesive device 10 can move more readily relative to surface 12. This condition allows the electroadhesive device 10 to move before and after an electrostatic adhesion voltage is applied. Well controlled electrical activation and de-activation enables fast adhesion and detachment, such as response times less than about 50 milliseconds, for example, while consuming relatively small amounts of power. Larger release times may also be valuable in many applications.

Electroadhesive device 10 includes electrodes 18 on an outside surface 11 of an insulating material 20. This embodiment is well suited for controlled attachment to insulating and weakly conductive inner materials 14 of various foreign objects 16. Other electroadhesive device 10 relationships between electrodes 18 and insulating materials 20 are also contemplated and suitable for use with a broader range of materials, including conductive materials. For example, a thin electrically insulating material (not shown) can be located on the surfaces of the electrodes where surface 12 is on a metallic object. As will be readily appreciated, a shorter distance between surfaces 11 and 12 results in a stronger electroadhesive force between the objects. Accordingly, a deformable surface 11 adapted to at least partially conform to the surface 12 of the foreign object 14 can be used.

As the term is used herein, an electrostatic adhesion voltage refers to a voltage that produces a suitable electrostatic force to couple electroadhesive device 10 to a foreign object 14. The minimum voltage needed for electroadhesive device 10 will vary with a number of factors, such as: the size of electroadhesive device 10, the material conductivity and spacing of electrodes 18, the insulating material 20, the size of the foreign object 14, the foreign object material 16, the presence of any disturbances to electroadhesion such as dust, other particulates or moisture, the weight of any objects being supported by the electroadhesive force, compliance of the electroadhesive device, the dielectric and resistivity properties of the foreign object, and the relevant gaps between electrodes and foreign object surface. In one embodiment, the electrostatic adhesion voltage includes a differential voltage between the electrodes 18 that is between about 500 volts and about 15 kilovolts. Even lower voltages may be used in micro applications. In one embodiment, the differential voltage is between about 2 kilovolts and about 5 kilovolts. Voltage for one electrode can be zero. Alternating positive and negative charges may also be applied to adjacent electrodes 18. The voltage on a single electrode may be varied in time, and in particular may be alternated between positive and negative charge so as to not develop substantial long-term charging of the foreign object. The resultant clamping forces will vary with the specifics of a particular electroadhesive device 10, the material it adheres to, any particulate disturbances, surface roughness, and so forth. In general, electroadhesion as described herein provides a wide range of clamping pressures, generally defined as the attractive force applied by the electroadhesive device divided by the area thereof in contact with the foreign object The actual electroadhesion forces and pressure will vary with design and a number of factors. In one embodiment, electroadhesive device 10 provides electroadhesive attraction pressures between about 0.7 kPa (about 0.1 psi) and about 70 kPa (about 10 psi), although other amounts and ranges are certainly possible. The amount of force needed for a particular application may be readily achieved by varying the area of the contacting surfaces, varying the applied voltage, and/or varying the distance between the electrodes and foreign object surface, although other relevant factors may also be manipulated as desired.

Although electroadhesive device 10 having electroadhesive gripping surface 11 of FIG. 1A is shown as having six electrodes 18, it will be understood that a given electroadhesive device or gripping surface can have just a single electrode. Furthermore, it will be readily appreciated that a given electroadhesive device can have a plurality of different electroadhesive gripping surfaces, with each separate electroadhesive gripping surface having at least one electrode and being adapted to be placed against or in close proximity to the foreign object to be gripped. Although the terms electroadhesive device, electroadhesive gripping unit and electroadhesive gripping surface are all used herein to designate electroadhesive components of interest, it will be understood that these various terms can be used interchangeably in various contexts. In particular, while a given electroadhesive device might comprise numerous distinct "gripping surfaces," these different gripping surfaces might themselves also be considered separate "devices" or alternatively "cnd effectors."

Figure 2A:
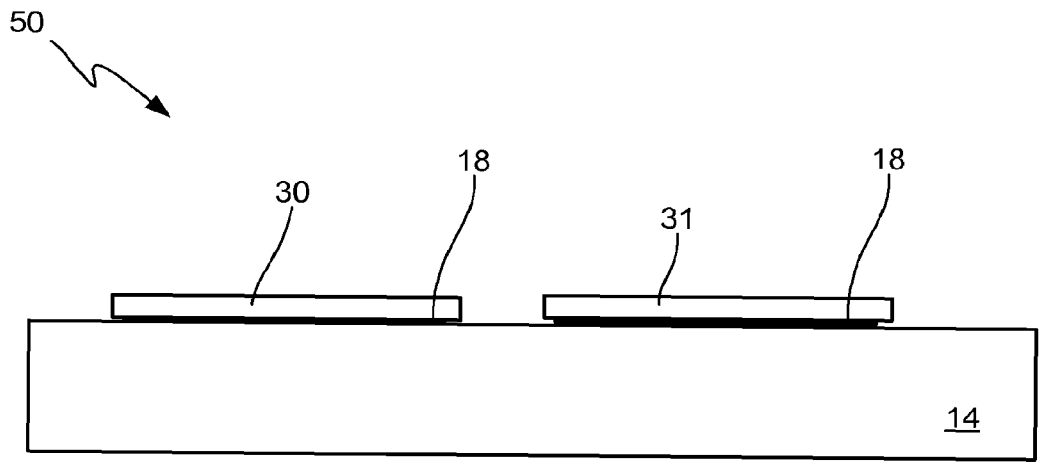
FIG. 2A illustrates in side cross-sectional view an exemplary pair of electroadhesive gripping surfaces or devices having single electrodes thereon.
Figure 2B:
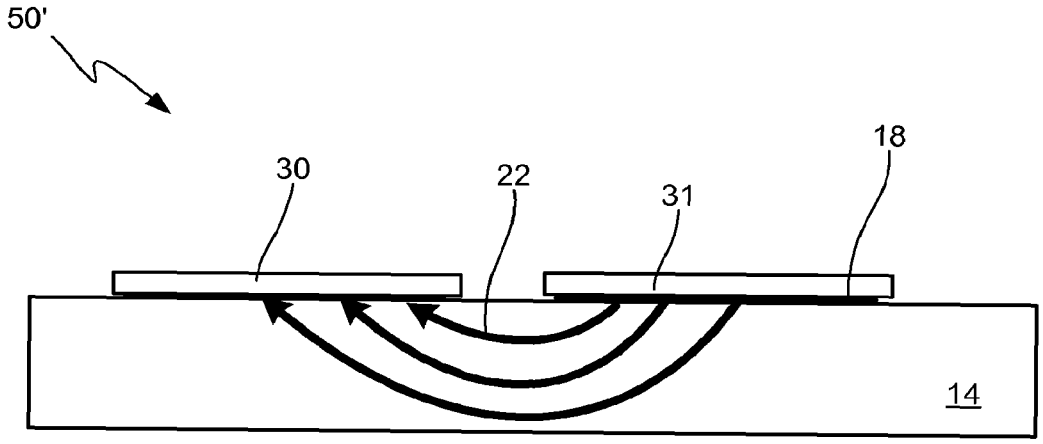
FIG. 2B illustrates in side cross-sectional view the exemplary pair of electroadhesive gripping surfaces or devices of FIG. 2A with voltage applied thereto.

Referring to FIGS. 2A and 2B, an exemplary pair of electroadhesive devices or gripping surfaces having single electrodes thereon is shown in side cross-sectional view. FIG. 2A depicts electroadhesive gripping system 50 having electroadhesive devices or gripping surfaces 30, 31 that are in contact with the surface of a foreign object 16, while FIG. 2B depicts activated electroadhesive gripping system 50' with the devices or gripping surfaces having voltage applied thereto. Electroadhesive gripping system 50 includes two electroadhesive devices or gripping surfaces 30, 31 that directly contact the foreign object 14. Each electroadhesive device or gripping surface 30, 31 has a single electrode 18 coupled thereto. In such cases, the electroadhesive gripping system can be designed to use the foreign object as an insulation material. When voltage is applied, an electric field 22 forms within foreign object 14, and an electrostatic force between the electroadhesive devices or gripping surfaces 30, 31 and the foreign object is created. Various embodiments that include numerous of these single electrode electroadhesive devices can be used, as will be readily appreciated.

In some embodiments, an electroadhesive gripping surface can take the form of a flat panel or sheet having a plurality of electrodes thereon. In other embodiments, the gripping surface can take a fixed shape that is matched to the geometry of the foreign object most commonly lifted or handled. For example, a curved geometry can be used to match the geometry of a cylindrical paint can or soda can. The electrodes may be enhanced by various means, such as by being patterned on an adhesive device surface to improve electroadhesive performance, or by making them using soft or flexible materials to increase compliance and thus conformance to irregular surfaces on foreign objects.

Figure 3A:
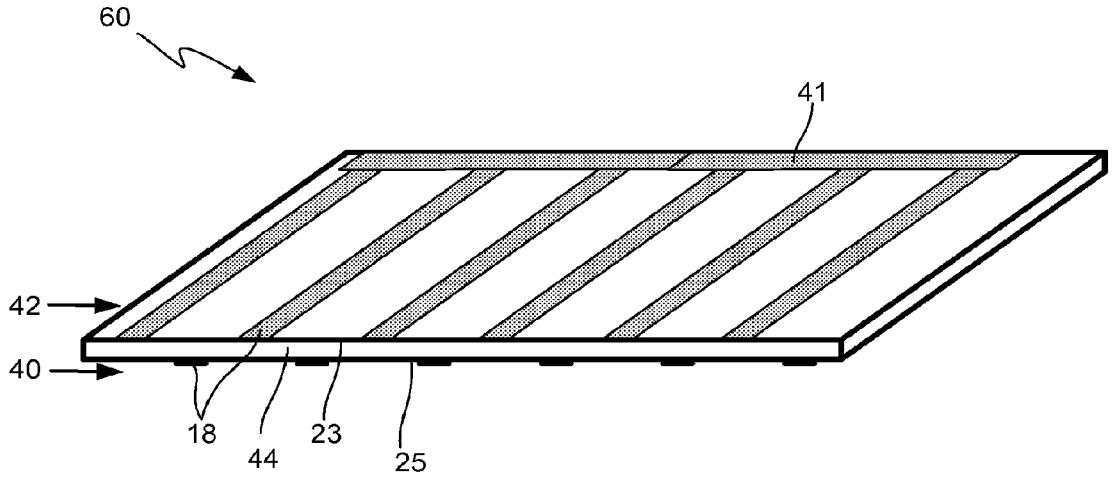
FIG. 3A illustrates in top perspective view an exemplary electroadhesive gripping surface in the form of a sheet with electrodes patterned on top and bottom surfaces thereof.
Figure 3B:
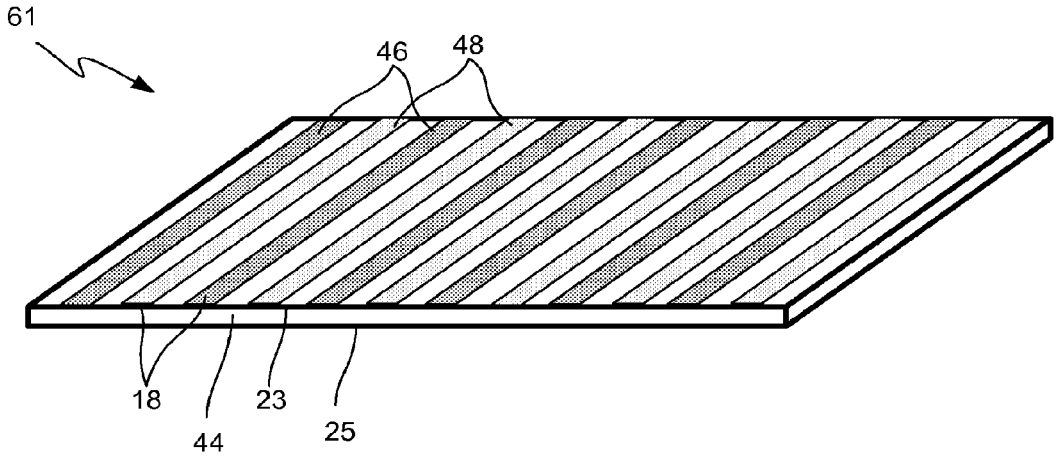
FIG. 3B illustrates in top perspective view an alternative exemplary electroadhesive gripping surface in the form of a sheet with electrodes patterned on a single surface thereof.

Continuing with FIGS. 3A and 3B, two examples of electroadhesive gripping surfaces in the form of flat panels or sheets with electrodes patterned on surfaces thereof are shown in top perspective view. FIG. 3A shows electroadhesive gripping surface 60 in the form of a sheet or flat panel with electrodes 18 patterned on top and bottom surfaces thereof. Top and bottom electrodes sets 40 and 42 are interdigitated on opposite sides of an insulating layer 44. In some cases, insulating layer 44 can be formed of a stiff or rigid material. In some cases, the electrodes as well as the insulating layer 44 may be compliant and composed of a polymer, such as an acrylic elastomer, to increase compliance. In one preferred embodiment the modulus of the polymer is below about 10 MPa and in another preferred embodiment it is more specifically below about 1 MPa. Various types of compliant electrodes suitable for use with the present invention are generally known, and examples are described in commonly owned U.S. Pat. No. 7,034,432, which is incorporated by reference herein in its entirety and for all purposes.

Electrode set 42 is disposed on a top surface 23 of insulating layer 44, and includes an array of linear patterned electrodes 18. A common electrode 41 electrically couples electrodes 18 in set 42 and permits electrical communication with all the electrodes 18 in set 42 using a single input lead to common electrode 41. Electrode set 40 is disposed on a bottom surface 25 of insulating layer 44, and includes a second array of linear patterned electrodes 18 that is laterally displaced from electrodes 18 on the top surface. Bottom electrode set 40 may also include a common electrode (not shown). Electrodes can be patterned on opposite sides of an insulating layer 44 to increase the ability of the electroadhesive end effector 60 to withstand higher voltage differences without being limited by breakdown in the air gap between the electrodes, as will be readily appreciated.

Alternatively, electrodes may also be patterned on the same surface of the insulating layer, such as that which is shown in FIG. 3B. As shown, electroadhesive gripping surface 61 comprises a sheet or flat panel with electrodes 18 patterned only on one surface thereof. Electroadhesive gripping surface 61 can be substantially similar to electroadhesive gripping surface 60 of FIG. 3A, except that electrodes sets 46 and 48 are interdigitated on the same surface 23 of a compliant insulating layer 44. No electrodes are located on the bottom surface 25 of insulating layer 44. This particular embodiment decreases the distance between the positive electrodes 18 in set 46 and negative electrodes 18 in set 48, and allows the placement of both sets of electrodes on the same surface of electroadhesive gripping surface 61. Functionally, this eliminates the spacing between the electrodes sets 46 and 48 due to insulating layer 44, as in embodiment 60. It also eliminates the gap between one set of electrodes (previously on bottom surface 25) and the foreign object surface when the top surface 23 adheres to the foreign object surface. Although either embodiment 60 or 61 can be used, these changes in the latter embodiment 61 do increase the electroadhesive forces between electroadhesive gripping surface 61 and the subject foreign object to be handled.

Figure 4A:
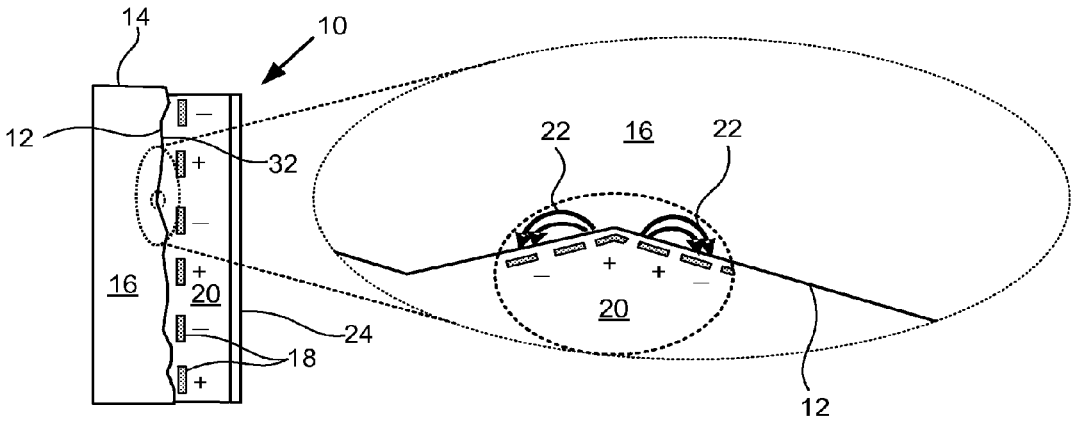
FIG. 4A illustrates in side cross-sectional regular and close-up views a deformable electroadhesive device conforming to the shape of a rough surface on a foreign object.
Figure 4B:
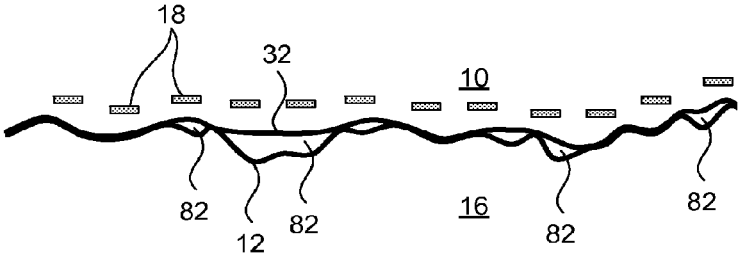
FIG. 4B illustrates in partial side cross-sectional view a surface of a deformable electroadhesive device initially when the device is brought into contact with a surface of a structure or foreign object.
Figure 4C:
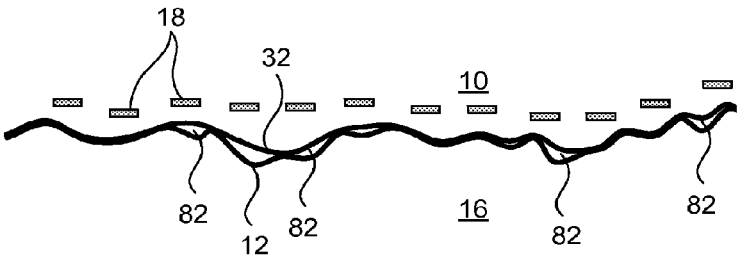
FIG. 4C illustrates in partial side cross-sectional view the surface shape of electroadhesive device of FIG. 4B and foreign object surface after some deformation in the electroadhesive device due to the initial force of electrostatic attraction and compliance.

Another distinguishing feature of electroadhesive devices described herein is the option to use deformable surfaces and materials in electroadhesive device 10 as shown in FIGS. 4A-4C. In one embodiment, one or more portions of electroadhesive device 10 are deformable. In a specific embodiment, this includes surface 32 on device 10. In another embodiment, insulating material 20 between electrodes 18 is deformable. Electroadhesive device 10 may achieve the ability to deform using material compliance (e.g., a soft material as insulating material 20) or structural design (e.g., see cilia or hair-like structures). In a specific embodiment, insulating material 20 includes a bendable but not substantially elastically extendable material (for example, a thin layer of mylar). In another embodiment insulating material 20 is a soft polymer with modulus less than about 10 MPa and more specifically less than about 1 MPa.

Electrodes 18 may also be compliant. Compliance for insulating material 20 and electrodes 18 may be used in any of the electroadhesive device arrangements 10 described above. Compliance in electroadhesive device 10 permits an adhering surface 32 of device 10 to conform to surface 12 features of the object it attaches to. FIG. 4A shows a compliant electroadhesive device 10 conforming to the shape of a rough surface 12 in accordance with a specific embodiment of the present invention.

Adhering surface 32 is defined as the surface of an electroadhesive device that contacts the substrate surface 12 being adhered to. The adhering surface 32 may or may not include electrodes. In one embodiment, adhering surface 32 includes a thin and compliant protective layer that is added to protect electrodes that would otherwise be exposed. In another embodiment, adhering surface 32 includes a material that avoids retaining debris stuck thereto (e.g., when electrostatic forces have been removed). Alternatively, adhering surface 32 may include a sticky or adhesive material to help adhesion to a wall surface or a high friction material to better prevent sliding for a given normal force.

Compliance in electroadhesive device 10 often improves adherence. When both electrodes 18 and insulating material 20 are able to deform, the adhering surface 32 may conform to the micro- and macro-contours of a rough surface 12, both initially and dynamically after initial charge has been applied. This dynamic compliance is described in further detail with respect to FIG. 4B. This surface electroadhesive device 10 compliance enables electrodes 18 get closer to surface 12, which increases the overall clamping force provided by device 10. In some cases, electrostatic forces may drop off with distance (between electrodes and the wall surface) squared. The compliance in electroadhesive device 10, however, permits device 10 to establish, dynamically improve and maintain intimate contact with surface 14, thereby increasing the applied holding force applied by the electrodes 18. The added compliance can also provide greater mechanical interlocking on a micro scale between surfaces 12 and 32 to increase the effective friction and inhibit sliding.

The compliance permits electroadhesive device 10 to conform to the wall surface 12 both initially—and dynamically after electrical energy has been applied. This dynamic method of improving electroadhesion is shown in FIGS. 4B and 4C in accordance with another embodiment of the present invention. FIG. 4B shows a surface 32 of electroadhesive device 10 initially when the device 10 is brought into contact with surface 12 of a structure with material 16. Surface 12 may include roughness and non-uniformities on a macro, or visible, level (for example, the roughness in concrete can easily be seen) and a microscopic level (most materials).

At some time when the two are in contact as shown in FIG. 4B, electroadhesive electrical energy is applied to electrodes 18. This creates a force of attraction between electrodes 18 and wall surface 12. However, initially, as a practical matter for most rough surfaces, as can be seen in FIG. 4B, numerous gaps 70 are present between device surface 32 and wall surface 12. The number and size of these gaps 70 affects electroadhesive clamping pressures. For example, at macro scales electrostatic clamping is inversely proportional to the square of the gap between the substrate 16 and the charged electrodes 18. Also, a higher number of electrode sites allows device surface 32 to conform to more local surface roughness and thus improve overall adhesion. At micro scales, though, the increase in clamping pressures when the gap is reduced is even more dramatic. This increase is due to Paschen's law, which states that the breakdown strength of air increases dramatically across small gaps. Higher breakdown strengths and smaller gaps imply much higher electric fields and therefore much higher clamping pressures. Clamping pressures may be increased, and electroadhesion improved, by using a compliant surface 32 of electroadhesive device 10, or an electroadhesion mechanism that conforms to the surface roughness.

When the force of attraction overcomes the compliance in electroadhesive device 10, these compliant portions deform and portions of surface 32 move closer to surface 12. This deformation increases the contact area between electroadhesive device 10 and wall surface 12, increases electroadhesion clamping pressures, and provides for stronger electroadhesion between device 10 and wall 14. FIG. 4C shows the surface shape of electroadhesive device 10 and wall surface 12 after some deformation in electroadhesive device 10 due to the initial force of electrostatic attraction and compliance. Many of the gaps 70 have become smaller.

This adaptive shaping may continue. As the device surface 32 and wall surface 12 get closer, the reducing distance therebetween in many locations further increases electroadhesion forces, which causes many portions of electroadhesive device 10 to further deform, thus bringing even more portions of device surface 32 even closer to wall surface 12. Again, this increases the contact area, increases clamping pressures, and provides for stronger electroadhesion between device 10 and wall 14. The electroadhesive device 10 reaches a steady state in conformity when compliance in the device prevents further deformation and device surface 32 stops deforming.

In some embodiments, electroadhesive device 10 includes porosity in one or more of electrodes 18, insulating material 20 and backing 24. Pockets of air may be trapped between surface 12 and surface 32; these air pockets may reduce adaptive shaping. Tiny holes or porous materials for insulator 20, backing 24, and/or electrodes 18 allows trapped air to escape during dynamic deformation. Thus, electroadhesive device 10 is well suited for use with rough surfaces, or surfaces with macroscopic curvature or complex shape. In one embodiment, surface 12 includes roughness greater than about 100 microns. In a specific embodiment, surface 12 includes roughness greater than about 3 millimeters.

An optional backing structure 24, such as shown in FIGS. 1A and 4A, can attach to insulating material 20 and include a rigid or non-extensible material. Backing layer or structure 24 can provide structural support for the compliant electroadhesive device. Backing layer 24 also permits external mechanical coupling to the electroadhesive device to permit the device to be used in larger devices, such as wall-crawling robots and other devices and applications described below.

With some electroadhesive devices 10, softer materials may warp and deform too much under mechanical load, leading to suboptimal clamping. To mitigate these effects, electroadhesive device 10 may include a graded set of layers or materials, where one material has a low stiffness or modulus for coupling to the wall surface and a second material, attached to a first passive layer, which has a thicker and/or stiffer material. Backing structure 24 may attach to the second material stiffer material. In a specific embodiment, electroadhesive device 10 included an acrylic elastomer of thickness approximately 50 microns as the softer layer and a thicker acrylic elastomer of thickness 1000 microns as the second support layer. Other thicknesses may be used.

The time it takes for the changes of FIGS. 4B and 4C may vary with the electroadhesive device 10 materials, electroadhesive device 10 design, the applied control signal, and magnitude of electroadhesion forces. The dynamic changes can be visually seen in some electroadhesive devices. In one embodiment, the time it takes for device surface 32 to stop deforming can be between about 0.01 seconds and about 10 seconds. In other cases, the conformity ceasing time is between about 0.5 second and about 2 seconds.

In some embodiments, electroadhesion as described herein permits fast clamping and unclamping times and may be considered almost instantaneous. In one embodiment, clamping or unclamping may be achieved in less than about 50 milliseconds. In a specific embodiment, clamping or unclamping may be achieved in less than about 10 milliseconds. The speed may be increased by several means. If the electrodes are configured with a narrower line width and closer spacing, then speed is increased using conductive or weakly conductive substrates because the time needed for charge to flow to establish the electroadhesive forces is reduced (basically the "RC" time constant of the distributed resistance-capacitance circuit including both electroadhesive device and substrate is reduced). Using softer, lighter, more adaptable materials in device 10 will also increase speed. It is also possible to use higher voltage to establish a given level of electroadhesive forces more quickly, and one can also increase speed by overdriving the voltage temporarily to establish charge distributions and adaptations quickly. To increase unclamping speeds, a driving voltage that effectively reverses polarities of electrodes 18 at a constant rate may be employed. Such a voltage prevents charge from building up in substrate material 16 and thus allows faster unclamping. Alternatively, a moderately conductive material 20 can be used between the electrodes 18 to provide faster discharge times at the expense of some additional driving power required.

As the term is used herein, an electrostatic adhesion voltage refers to a voltage that produces a suitable electrostatic force to couple electroadhesive device 10 to a wall, substrate or other object. The minimum voltage needed for electroadhesive device 10 will vary with a number of factors, such as: the size of electroadhesive device 10, the material conductivity and spacing of electrodes 18, the insulating material 20, the wall or object material 16, the presence of any disturbances to electro adhesion such as dust, other particulates or moisture, the weight of any structures mechanically coupled to electroadhesive device 10, compliance of the electroadhesive device, the dielectric and resistivity properties of the substrate, and the relevant gaps between electrodes and substrate. In one embodiment, the electrostatic adhesion voltage includes a differential voltage between the electrodes 18 that is between about 500 volts and about 10 kilovolts. In a specific embodiment, the differential voltage is between about 2 kilovolts and about 5 kilovolts. Voltage for one electrode can be zero. Alternating positive and negative charges may also be applied to adjacent electrodes 18.

Various additional details and embodiments regarding electroadhesion, electrolaminates, electroactive polymers, wall-crawling robots, and applications thereof can be found at, for example, U.S. Pat. Nos. 6,586,859; 6,911,764; 6,376,971; 7,411,332; 7,551,419; 7,554,787; and 7,773,363; as well as International Patent Application No. PCT/US2011/029101; and also U.S. patent application Ser. No. 12/762,260, each of the foregoing of which is incorporated by reference herein.

Active Electrostatic Cleaning

As noted above, electroadhesion can often involve using compliant or flexible pads or other surfaces with one or more electrodes to achieve reversible adhesion to various foreign objects. Such arrangements can generally be used to facilitate the attachment of electroadhesive devices to wall surfaces or other substrates, as well as the picking, placement and otherwise handling of smaller foreign objects. Although the foregoing illustrations have focused primarily upon attaching an electroadhesive device to a wall or other similarly large substrate, it will be readily appreciated that reverse arrangements can also apply—in that relatively smaller objects can be electrostatically adhered to a larger electrostatic device.

As such, the various foregoing electroadhesive concepts can generally also be applied to the cleaning or picking up of dust, leaves and other similar particles and objects. In fact, various electroadhesive sheets, pads, electrolaminate devices and other similar applications of electroadhesion have been found to interact suitably with a variety of household particles, such as dust, hair, leaves, dirt, pebbles, glass shards, crumbs, other organic matter, similar small objects and the like. Such interactions can be favorably manipulated in a controlled manner to result in a wide variety of efficient cleaning devices, systems and techniques.

Various particular applications can include indoor uses, such as a duster, broom, vacuum substitute or other household interior cleaner, for example. Other particular applications can include a variety of outdoor uses, such as a leaf collector or trash or recycling collecting system, for example. There are also many ways in which the device can be optimized for dusting and other applications involving the collection or cleaning of fine or minute particles, as set forth in greater detail below.

Figure 5:
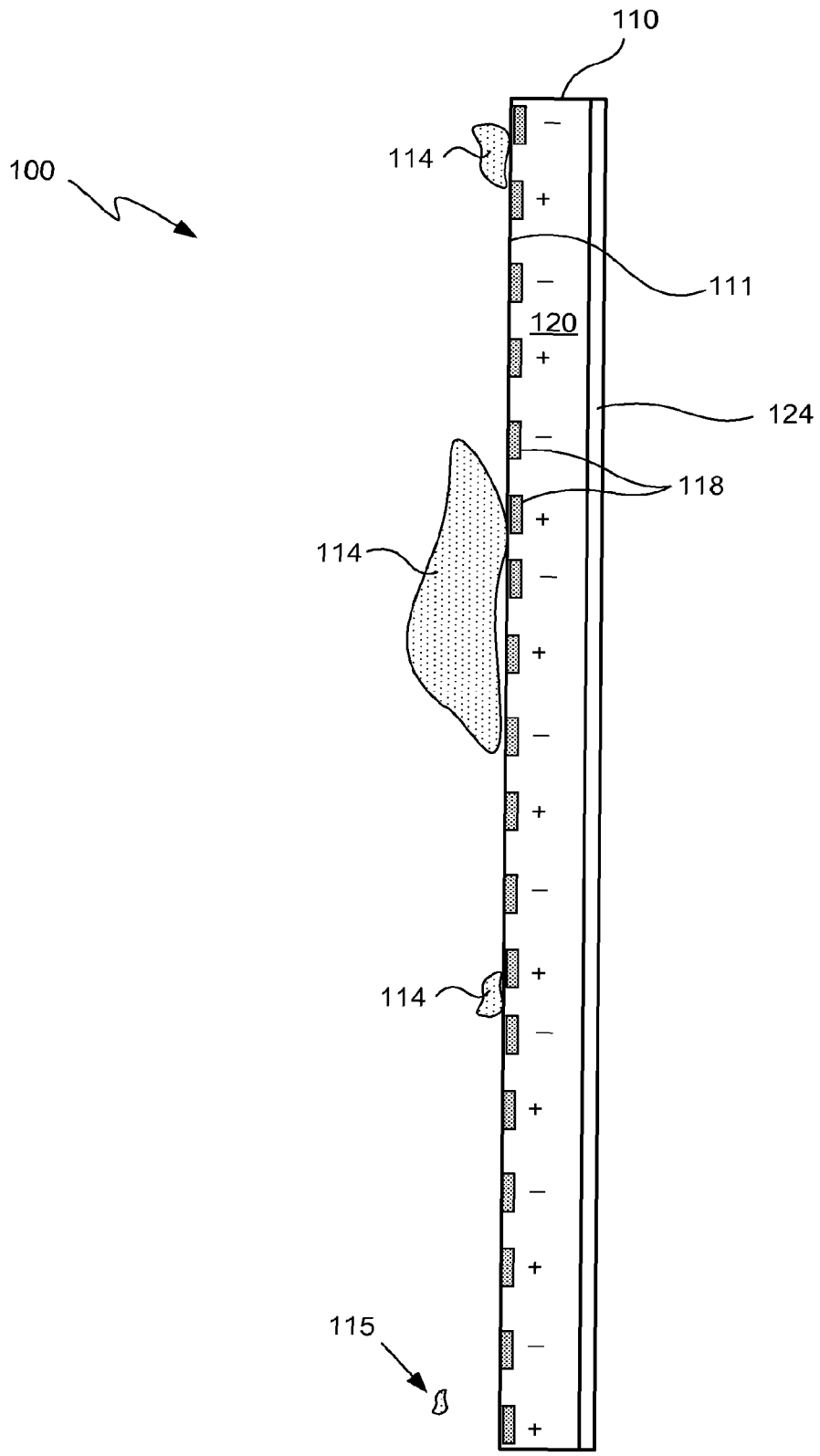
FIG. 5 illustrates in side cross-sectional view an exemplary electroadhesive device having a plurality of smaller foreign objects adhered thereto according to one embodiment of the present invention.

Transitioning now to FIG. 5, an exemplary electroadhesive device having a plurality of smaller foreign objects adhered thereto according to one embodiment of the present invention is presented in side cross-sectional view as a general application of a relatively larger device that can be used to adhere to smaller items. Overall environment 100 can include an electroadhesive device 110 that is configured to adhere a plurality of foreign objects 114 thereto. Any or all of foreign objects 114 can include, for example, dust, dirt, pebbles, crumbs, hair, garbage and/or a wide variety of other particulate matter. Many other items can also be adhered to the electroadhesive device 110, as will be readily appreciated.

Similar to the foregoing general embodiments above, electroadhesive device 110 can include one or more electrodes 118 located at or near an "electroadhesive gripping surface" 111 thereof, as well as an insulating material 120 between electrodes 118 and a backing 124 or other supporting structural component. Such a backing 124 may not be used in all embodiments, and the insulating material 120 and/or backing 124 can be rigid or flexible, as may be desirable for a particular application. For example, the entire device 110 can be a flexible sheet in some instances. For purposes of illustration, electroadhesive device 110 is shown as having eighteen electrodes in nine pairs, although it will be readily appreciated that more or fewer electrodes can be used in a given electroadhesive device. Further, such electrodes 118 can be spread out in more than one dimension, such as across an entire surface in two dimensions.

Also similar to the foregoing general embodiments, an electroadhesive force can be "felt" or experienced by each individual foreign object or particle 114 that is adhered to surface 111. In general, a given individual particle can be more susceptible to experiencing an individual electroadhesive force where the foreign object or particle 114 is big enough to be in comparable size with and/or to span at least two oppositely charged electrodes 118. In some embodiments, various foreign objects or particles 115 might be too small to be adhered effectively to the electroadhesive device 110. This can be caused by such particles not being big enough to span across multiple electrodes 118. Where a given particle 115 is so small that it would only experience being proximate a single electrode 118, then a resulting electroadhesive force may be minimal or nonexistent with respect to such a small foreign object or particle.

Accordingly, smaller electrodes 118 and spacing between electrodes can generally result in an ability to adhere smaller foreign objects and particles 114, 115. Such size and spacing of electrodes 118 can be referred to as the "pitch" in an overall electrode pattern, with a smaller pitch resulting in an improved ability to adhere smaller foreign objects and particles. Various design and operational considerations with respect to variable pitches can provide useful in the ability to clean and/or control differing sizes of objects and particles, as set forth in greater detail below.

Figure 6A:
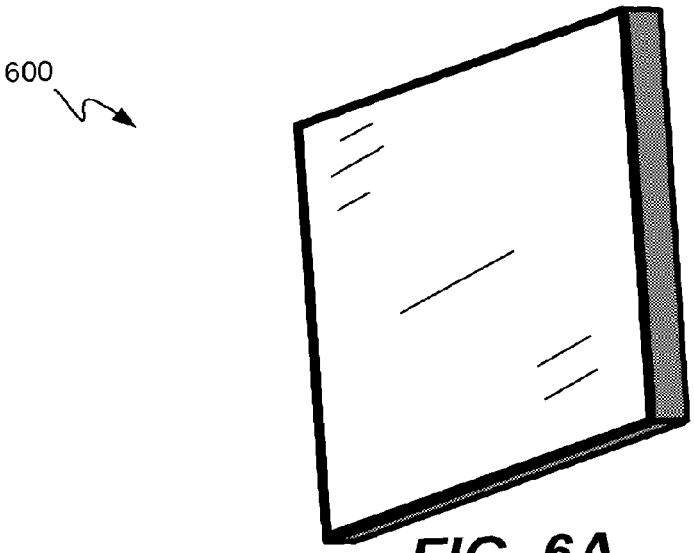
FIG. 6A illustrates in front perspective view an exemplary active electroadhesive cleaning pad with its power supply turned off according to one embodiment of the present invention.

Moving next to FIG. 6A, an exemplary active electroadhesive cleaning pad with its power supply turned off is illustrated in front perspective view. Overall environment 600 can include an active electroadhesive cleaning pad that can be identical or significantly similar to foregoing electroadhesive device 110 in many regards. This active electroadhesive cleaning pad can have, for example, an interactive front surface and a plurality of electrodes (not shown) that are disposed at, proximate to, or behind the interactive surface. An active power supply, such as a battery, capacitor, A/C source, or other suitable controllable power source (not shown) can supply a voltage to the electrodes in a controlled manner upon the actuation of a user input, for example. Such a user input can be made by way of a user input component, which can be a switch, button, knob, dial, or other similar component, as will be readily appreciated. As shown in environment 600, no power has been applied, such that no voltage is present at the electrodes and no electroadhesive force is present at the interactive surface. As would be expected, no foreign objects or particles are adhered to the interactive surface as a result.

Figure 6B:
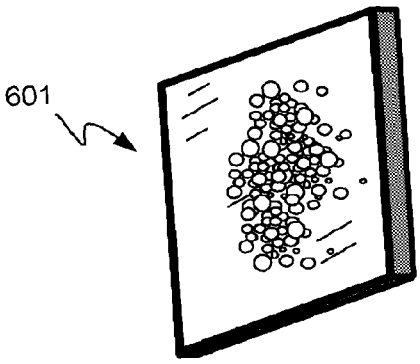
FIGS. 6B-6E illustrate in front perspective view the exemplary active electroadhesive cleaning pad of FIG. 6A with its power supply turned on and various types of particulate matter being adhered thereto according to various embodiments of the present invention.
Figure 6C:
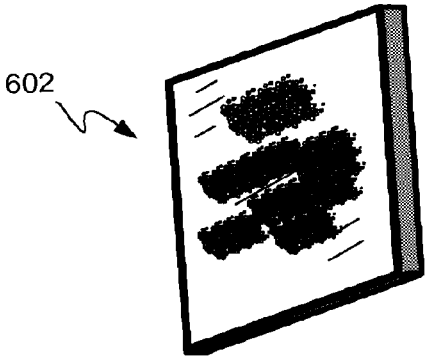
Figure 6D:
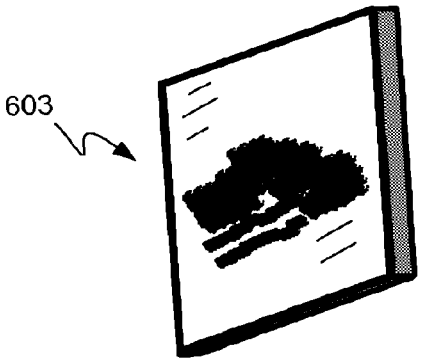

FIGS. 6B-6E each illustrate in similar front perspective views the exemplary active electroadhesive cleaning pad of FIG. 6A with its power supply turned on and various types of particulate matter being adhered thereto. As a first example, environment 601 in FIG. 6B depicts how a plurality of pebbles adhere to the electroadhesive cleaning pad. FIG. 6C shows an environment 602 where the cleaning pad has a collection of dirt adhered thereto, while FIG. 6D shows an environment 603 where a significant amount of dust is adhered to the cleaning pad. In addition to these examples, it will be readily appreciated that hair, crumbs, garbage and a wide variety of other particulate matter and foreign objects can be adhered to the cleaning pad.

Figure 6E:
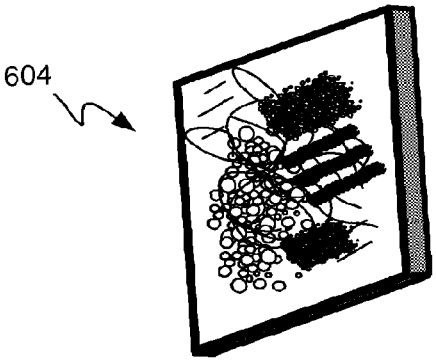

In fact, FIG. 6E depicts an environment 604 where a mixed variety of pebbles, dirt, dust and hair are all adhered to the electroadhesive cleaning pad at the same time. It is worth noting that a robust adhesion of such particulate matter and other foreign objects to the electroadhesive pad has been observed while the applied voltage is turned on. Such robust adhesion is sufficient to maintain the positions of the various objects and particulate matter even during a reasonable amount of shaking of or contact with the electroadhesive pad. When the voltage is removed (e.g., power is shut off) such that the various electroadhesive forces with respect to the particulate matter items is reduced or eliminated, then these foreign particles and items tend to readily fall away from the electroadhesive pad. As such, control of the applied voltage can result in significant control of the various particulate matter and other foreign objects adhered to the electroadhesive pad, device or system.

Depending on the various specific effects desired, the material or materials used for the interactive surface could be varied. The interactive surface material could be soft and tacky in nature, such as in the form of soft polyurethanes or silicones, for example, whereby additional passive adhesion forces could be created. Alternatively, more slippery surfaces could be used for the interactive surface material, such that the surface could be more easily cleaned. Such slippery surface materials could include one or more sheets of polyurethane, for example. Other types of materials could also be used to form all or portions of the interactive surface, as may be desired, and such other materials can include various fabrics, fibers, cloth, plastics and the like.

In addition to the types of materials used, various shapes, arrangements and configurations of the interactive surface or surfaces can also greatly affect the amount of compliance between the interactive surface and the various foreign objects and particulate matter to be cleaned. For example, when picking up relatively dried out and flat leaves that have a complex shape to them, it can be important that the interactive surface be flexible. As such, thin sheets that flexibly drape around relatively thin, larger and complex foreign objects, such as dried leaves, can be useful for these particularized applications. When picking up very small objects on a flat interactive surface, or when picking up fresh and pliable leaves, however, an electroadhesive pad having a more rigid backing has been found to be adequate. Compliance can also be achieved through structural means such as hair, flaps and/or other similar features on the interactive surface. As such, an overall larger pad or other electroadhesive cleaning device can include a relatively stiff backing coupled with numerous smaller hairs or flaps on the interactive surface itself to provide the compliance necessary to conform around the foreign objects to be cleaned. Such features can resemble the hairs or fibers found in common cleaning implements such as mops, brooms, brushes, dusters and the like, for a combined mechanical and electroadhesive cleaning of foreign objects.

Figure 7A:
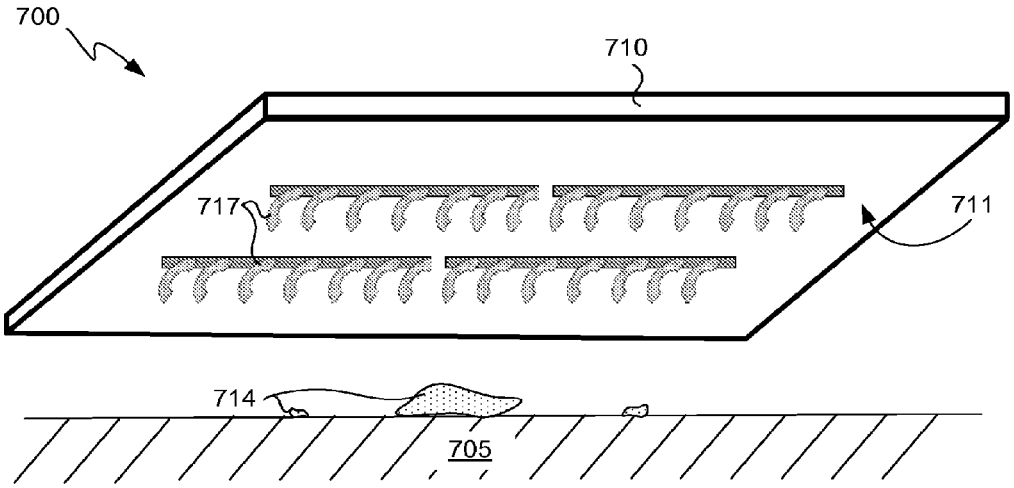
FIG. 7A illustrates in side elevation view an exemplary active electroadhesive cleaning device having hair or fibers along its interactive surface according to one embodiment of the present invention.

Turning next to FIG. 7A an exemplary active electroadhesive cleaning device having hair or fibers along its interactive surface is shown in side elevation view. As shown, environment 700 includes a plurality of foreign objects 714 that are dispersed about ground or floor surface 705. An active electroadhesive cleaning device 710 can include a variety of components that are fronted by an interactive surface 711 that is adapted to interact with the various foreign objects 714. One or more hairs or cilia 717 can be dispersed about interactive surface 711 to aid in the compliance of adhering the foreign objects 714 to the interactive surface.

Of course, one or more electrodes (not shown) disposed behind or otherwise located proximate to the interactive surface can also be used to generate electroadhesive forces with respect to each of foreign objects 714 when the interactive surface contacts the foreign objects or is placed in reasonably close proximity thereto. As noted above, the cilia 714 and/or one or more other features located at or about the interactive surface 711 can result in a deformable surface or surface region, such that the deformable surface portion can move closer to a respective foreign object 714 when the electroadhesive force is applied thereto.

Figure 7B:
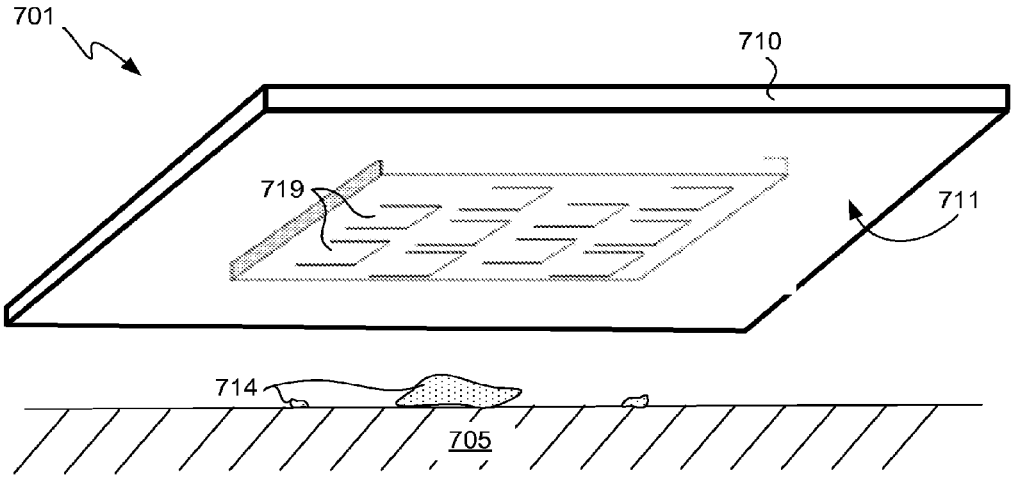
FIG. 7B illustrates in side elevation view an exemplary active electroadhesive cleaning device having a plurality of extendable flaps along its interactive surface according to one embodiment of the present invention.

FIG. 7B illustrates in side elevation view another compliance example in the form of an active electroadhesive cleaning device having a plurality of extendable flaps along its interactive surface. Alternative environment 701 can include the same or substantially similar particulate matter or foreign objects 714 along the ground or another floor surface 705. A similar active electroadhesive cleaning device 710 can have an interactive surface 711 to be placed proximate the foreign objects to be cleaned, as in the foregoing embodiment. Instead of (or in addition to) cilia, however, the interactive surface 711 in alternative environment 700 can include a plurality of flaps 719 that are partially coupled to and extendable from the interactive surface. Such flaps can be adapted to carry electroadhesive charge, similar to the foregoing interactive surfaces, but are much more flexible and compliant with respect to contacting the foreign objects to be cleaned, as will be readily appreciated.

Another feature that can be used effectively to control and manipulate particulate matter and other foreign objects to be cleaned can involve the use of patterned electrodes. As noted above, finer electrode patterns are thought to be more optimal for smaller sized particles, such that each individual particle "feels" the electrical field across a plurality of oppositely charged electrodes, in contrast to only being subject to a single electrode and thus typically a single polarity Larger electrode patterns will typically interact only with correspondingly larger or more conductive objects, such as leaves or larger trash items, for example. By designing electrode patterns appropriately, it is possible to tune what types of objects can be carried or otherwise manipulated for cleaning. It is also possible to have a relatively fine electrode pattern where changing the connectivity or addressing appropriate electrode regions can tune the electroadhesion to the sized objects of interest. Thus, electroadhesion can be used not only as a general cleaner but also as a specific cleaner to separate out certain object sizes or materials from others in a pile or "dirty" region.

This concept is illustrated with respect to FIGS. 8A through 9C. Beginning with FIG. 8A, an exemplary checkerboard type electrode pattern for use with respect to a suitable interactive surface is shown in top plan view. It will be readily appreciated that a suitable power source, one or more user input devices or components, interactive surface(s) and other components can be used in conjunction with the electrodes shown in electrode pattern 800, but that such items are not displayed here for purposes of simplicity in illustration and discussion.

Electrode pattern 800 can involve a checkerboard arrangement of alternating positively and negatively charged regions. This can be accomplished, for example, by alternating positive and negative charges across each of the electrodes in the pattern. As shown, electrode 818 can be positively charged, while adjacent electrode 819 can be negatively charged. Again, this alternating charged pattern can continue in two dimensions across the entire electrode pattern 800. Where this is done at the individual electrode level, as in pattern 800, then the smallest pitch possible for that pattern can be observed. That is, pattern 800 is configured such that it will be able to attract the smallest foreign objects that it possibly can. Such smallest foreign objects possible might generally be about the size of one electrode given the simple geometry of this particular pattern, as will be readily appreciated.

Figure 8A:
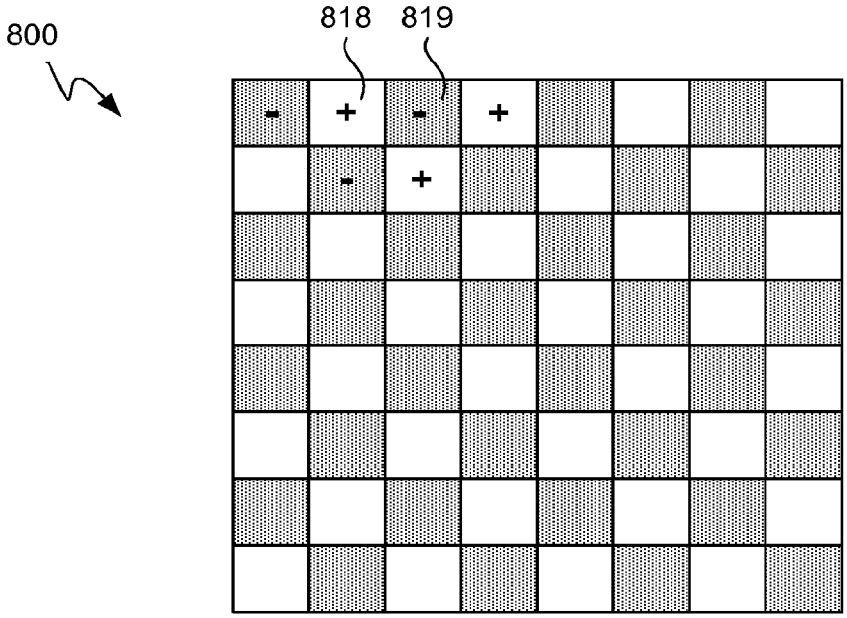
FIG. 8A illustrates in top plan view an exemplary checkerboard type electrode pattern for use with respect to a suitable interactive surface according to one embodiment of the present invention.
Figure 8B:
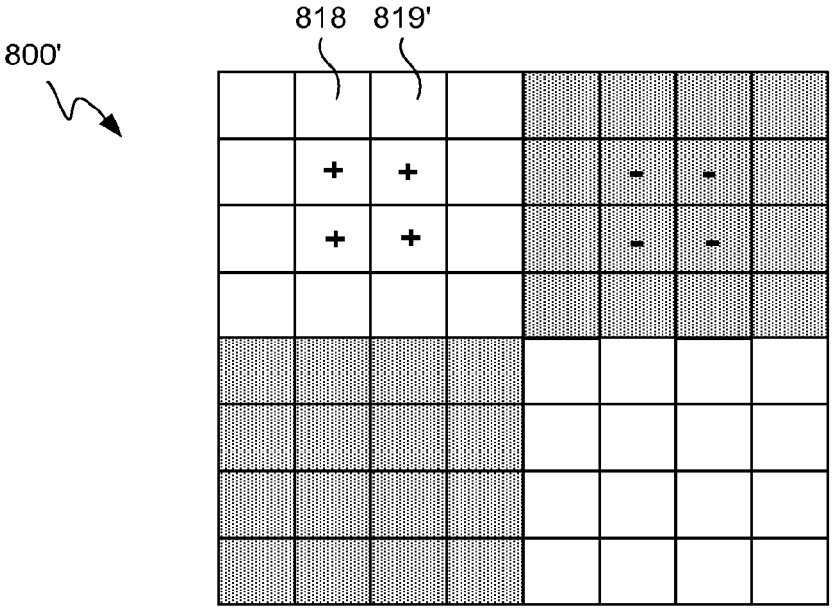
FIG. 8B illustrates in top plan view the exemplary checkerboard type electrode pattern of FIG. 8A having an alternatively charged configuration according to one embodiment of the present invention.

Continuing with FIG. 8B the exemplary checkerboard type electrode pattern of FIG. 8A having an alternatively charged configuration is similarly illustrated in top plan view. Alternatively configured electrode pattern 800' is notably formed on the exact same electrodes and components as pattern 800 is. That is, the same 64 electrodes are used to form pattern 800 and alternative pattern 800'. Unlike the previous finer pitch 64 alternating region pattern 800, the alternative pattern 800' is configured such that there are only 4 alternating regions. This can be done by manipulating the charges at some of the electrodes such that an effectively larger pitch is created. For example, while the charge on electrode 818 stays the same, the adjacent electrode 819' has had its charge switched from negative to positive. Similar charge switches to various other electrodes in the 64 electrode pattern have also been made to achieve the simpler four region result, as will be readily appreciated.

Of course, a vast variety of other electrode patterns can alternatively be achieved by manipulating the charge to each of the electrodes in a similar manner. For example, a 4×4 pattern can similarly be achieved, in addition to the 8×8 and 2×2 patterns shown in FIGS. 8A and 8B. Alternatively, other patterns such as 4×2, 1×1 and 2×1 can also be configured. Further, the number of electrodes or effective electrode regions is not limited to 64, and can be smaller than or substantially greater than this number. As such, an infinite number of possible electrode arrangements are possible, with many such arrangement being configurable to numerous different electrode patterns. Such different electrode patterns can also have differing pitches.

Figure 9A:
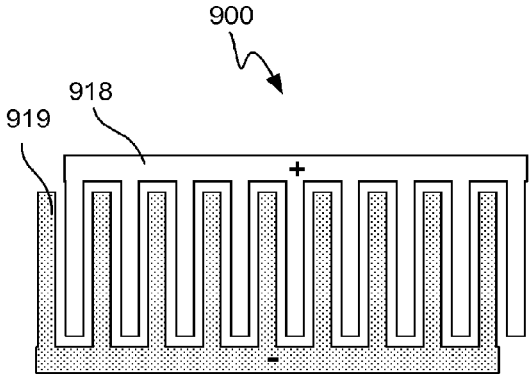
FIG. 9A illustrates in top plan view an exemplary interdigitated electrode pattern for use with respect to a suitable interactive surface according to one embodiment of the present invention.
Figure 9B:
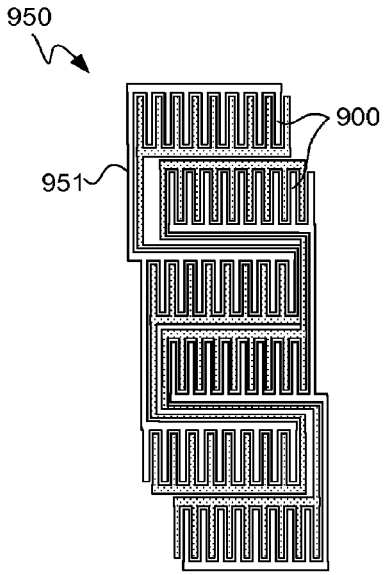
FIG. 9B illustrates in top plan view an exemplary interdigitated electrode pattern incorporating multiple repetitions of the pattern in FIG. 9A according to one embodiment of the present invention.
Figure 9C:
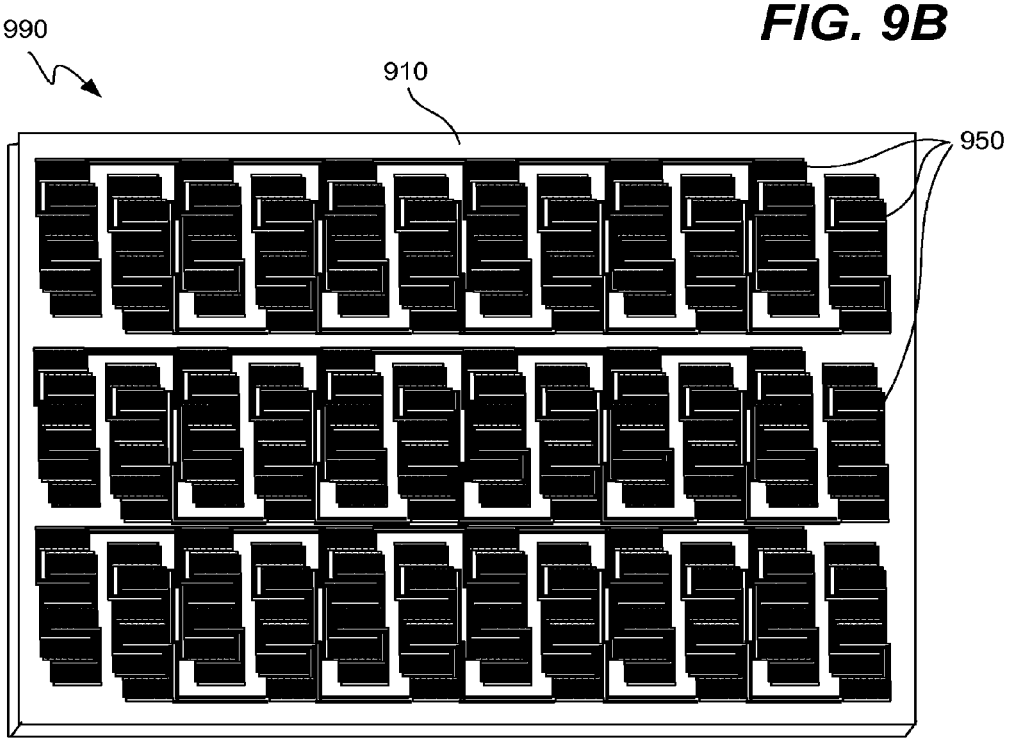
FIG. 9C illustrates in top plan view an exemplary interactive surface of an active electroadhesive cleaning device having an extended electrode pattern incorporating multiple repetitions of the pattern in FIG. 9B according to one embodiment of the present invention.

Moving next to FIGS. 9A-9C, a more complex example of electrode patterns involving interdigitated electrode arrangements is provided. Starting with FIG. 9A, an exemplary interdigitated electrode pattern for use with respect to a suitable interactive surface is similarly shown in top plan view. Again, only the electrode pattern is being illustrated for purposes of simplicity. As shown in electrode pattern or arrangement 900, only two electrodes 918, 919 are present. Electrode 918 can be positively charged, while electrode 919 can be negatively charged, and the polarities of both electrodes can preferably be reversible, as may be desired.

Electrodes 918 and 919 are interdigitated, such that numerous different regions for electroadhesive forces to form can be observed from just these two electrodes. Due to the particular geometry of electrodes 918 and 919, the pitch for this particular patterned arrangement would effectively be the width of an interdigitated "finger" in many instances. In the event that these fingers are relatively narrow then, the size of particulate matter or other foreign objects that can be adhered to or otherwise handled by an electroadhesive cleaning device or system using patterned arrangement 900 would be relatively small.

FIG. 9B similarly illustrates in top plan view an exemplary interdigitated electrode pattern incorporating multiple repetitions of the pattern in FIG. 9A. Overall electrode pattern 950 includes six repeated instances or copies of pattern 900 from FIG. 9A. These "copies" of pattern 900 are effectively interdigitated within each other, and are then connected by common buses or connectors 951. Each such common bus or connector 951 can be used to couple like charged regions on a subset of the six repeated copies of pattern 900, such as on half of the repeated copies. In this particular example, each connector 951 can be arranged to connect similarly chargeable regions only on alternating "fingers" 900 of overall pattern 950. That is, a single connector 951 would connect only the positively (or alternatively negatively) charged regions of the first, third and fifth subpatterns 900 within overall pattern 950. Similar connections 951 could then be made with respect to the second, fourth and sixth subpatterns respectively.

When connected in this overall manner by connectors 951, the overall pattern 950 can then be manipulated to alter the observable pitch of the pattern. For a finer pitch, for example, all positive and negative electrode regions can be charged as shown at the finest possible levels across the entire pattern 950. For a larger pitch though, all of the interconnected regions on the first, third and fifth subpatterns 900 can all be set to the same positive or negative charge, while all of the interconnected regions on the second, fourth and sixth subpatterns 900 can all be set to the same charge that is opposite those of the other three subpatterns. For example, the entirety of the first, third and fifth subpatterns 900 can be positive, while the entirety of the second, fourth and sixth subpatterns can be negative. This then results in a larger overall pitch for a result that would then tend to ignore particles of a size greater than the width of a single finger of electrode 918 but smaller than the overall width of the subpattern 900.

FIG. 9C extrapolates this concept into yet a further extended electrode pattern incorporating multiple repetitions of the pattern in FIG. 9B. As shown, overall electrode pattern 990 can be disposed behind or proximate an interactive surface 910 of an electroadhesive cleaning device. A plurality of subpatterns 950 that correspond to the overall pattern shown in FIG. 9B are provided in an interdigitated pattern themselves across overall electrode pattern 990 in multiple directions. Again, further common buses or connectors can be formed between each of the subpatterns 950, such that additional control can be had with respect to designating the pitch on overall pattern 990. Further iterations of this process can also be implemented so as to add further control over designating pitch sizes, as will be readily appreciated.

Figure 10A:
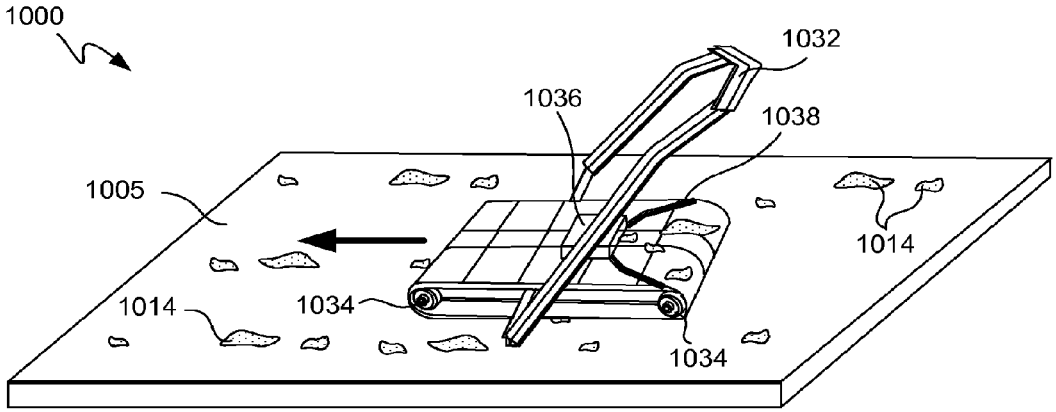
FIG. 10A illustrates in side perspective view an exemplary track based active electro adhesive cleaning device according to one embodiment of the present invention.

FIG. 10A illustrates in side perspective view an exemplary track based active electroadhesive cleaning device according to one embodiment of the present invention. Track based active electroadhesive cleaning device 1000 can be adapted to move across and clean debris or foreign objects 1014 from ground or floor 1005. In addition to having a power supply or source, input component(s), and various electrodes similar to those described in greater detail above, cleaning device 1000 also includes a number of additional features. A handle 1032 can be coupled to a device frame (not shown) and can be provided for a user to manually operate or manipulate the overall device 1000, such as in a forward motion (indicated by the arrow) across surface 1005. In some embodiments, one or more rollers 1034 may house a power supply, such as battery, driving electronics, such as high voltage DC-DC converters, other pertinent switches and circuitry, and the like.

The interactive surface can be configured in the form of a continuous loop or track situated across one or more rollers 1034, and the various electrodes (not shown) can be arranged in a pattern behind or adjacent to the interactive surface, as will be readily appreciated. As the device 1000 moves across foreign dirty surface or region 1005, voltage is applied at the electrodes proximate the portion of the interactive surface beneath the device, such that particulate matter and/or foreign objects 1014 on the foreign surface are adhered to that portion of the interactive surface that is beneath the overall device and has electroadhesive forces being conducted therethrough. In some embodiments, it is also possible to leave the continuous loop tracked interactive surface in an "always on" state, such that the entire surface beneath the device and on the upper side of the device is always charged. As such, continuous dust removal can occur through one or more mechanical processes, such as vibration, rubbing or vacuum, for example.

As the tracked interactive surface departs foreign surface 1005 at the backside of the device during the overall forward motion of the device, at least some of the foreign objects 1014 can remain adhered to the interactive surface and are thus carried up and away from the foreign surface or dirty region and across the upper tracked portion of the device 1000 accordingly. A dustbin 1036 or other receptacle for particulate matter or foreign objects can be disposed on cleaning device 1000, and this dustbin or receptacle can be arranged to collect dust and other foreign objects from off of the interactive surface. One or more brushes, rollers or other guides 1038 can serve to direct foreign objects 1014 and other particulate matter from the interactive surface into the receptacle 1036.

Figure 10B:
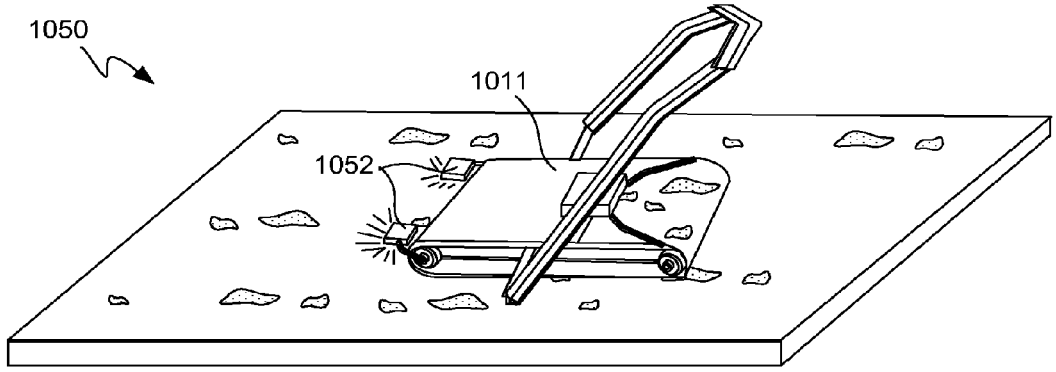
FIG. 10B illustrates in side perspective view an exemplary alternative track based active electroadhesive cleaning device having ion charge sprayers according to one embodiment of the present invention.

FIG. 10B illustrates in side perspective view an exemplary alternative track based active electroadhesive cleaning device having ion charge sprayers according to one embodiment of the present invention. Alternative track based active electroadhesive cleaning device or system 1050 can be similar to the foregoing device 1000 in a number of regards. In addition to having an identical or similar handle, rollers, continuous tracked interactive surface 1011, receptacle and guides, device or system 1050 can also include one or more ion charge sprayers 1052. Such ion charge sprayer(s) can spray or otherwise disperse ionic charges in front of the overall active cleaning device or system.

In this arrangement or system, the actual interactive surface or sheet might have only one electrode associated therewith, with such a single electrode being only positively or negatively charged. As such, the sprayed ionic charges can be of the opposite polarity from the single charge across the tracked interactive surface or electroadhesive sheet. For example, the ion charge sprayers 1052 can spray negative charges on foreign dust particles, while the interactive surface would be charged positively such that it picks up all of the now affirmatively negatively charged dust particles. One advantage of this embodiment is that the polarity of the charge on the dust particles and other foreign objects to be cleaned can be accurately predicted, since specific ion charges to that effect are being sprayed. As such, the interactive surface can be much simpler in that it might require only a single electrode of a polarity that is opposite to the sprayed charge.

In these particular tracked electroadhesive cleaning device embodiments, as well as in various other embodiments, several additional device and system aspects can apply. For example, the magnitude of voltage on an electroadhesive clamping component or components can be varied to pick up various specifically targeted objects, such as by size and/or weight. Such targeting can also be accomplished by using a patterned electrode arrangement with variable pitches, as detailed above.

It is also contemplated that alternating the polarity of the electroadhesive clamping components can provide several advantages. For example, the particles or other foreign objects are less likely to become damaged or disadvantageously charged up themselves when first clamped and then released, such as by reducing, shutting off or reversing the polarity of the applied charge. In some cases, it may be possible to use this phenomenon to disperse or repel the particles or foreign objects away from the interactive surface in a desirable or otherwise controllable manner. Where a direct current pulse is used, for example, a negative polarity pulse for a short duration can helps with the prompt release or repelling of dirt and other foreign objects from the electroadhesive surface.

In various embodiments, the disclosed electroadhesive cleaning devices and systems can employ a mechanical means of releasing the dust or other foreign objects more fully when the voltage is at different stages, such as fully on, reduced, switched off, or even reversed. Some approaches in helping to remove particles and foreign objects from the interactive surface can include jolting the device, such as with an electromagnetic solenoid, for example, vibrating the device, such as with an electromagnetic coil or embedded electroactive polymer device, for example, or the use of an air or water jet that is squirted parallel to the face of the interactive surface. Since reducing or switching off the input voltage often does not often result in a full release of particles, and especially lighter particles such as dust, it may be desirable to use a mechanical wiper or brush to help clean or recycle the interactive surface.

One way to do this continuously is in a roller or continuous tracked embodiment, such as cleaning device 1000 set forth above. The interactive surface can be in the form of an electroadhesive track or belt that can have several distinct patterns or sections along its length. In such an arrangement, a front roller can be used to charge the interactive surface as it begins to contact the foreign surface to be cleaned, and a rear roller can be used to discharge the interactive surface or belt after the surface and adhered foreign objects rotate up and away from the foreign surface being cleaned. This can be accomplished without causing shorting along one continuous electrode that runs from the front to the back of the device, such as where the electroadhesion electronics are mounted fully inside the front roller. In such an arrangement, there can be a rolling electrical contact instead of a sliding contact. Other types of electroadhesive interactive surfaces can also be employed for such cleaning purposed, including "flattened tire" and "wheels with flap" designs, such as those described in U.S. Pat. No. 7,554,787, as incorporated above.

In various embodiments, interactive surfaces such as the electroadhesive pads shown in FIGS. 6A-6E and the continuous electroadhesive belt or track shown in FIGS. 10A-10B can be treated as a consumable or disposable that can be changed after several cleaning operations. In some embodiments, many thin layer pads or tracks can be stacked on top of each other, such that a user can simply peel off and dispose of the outermost pad or track layer when it gets too old, damaged or dirty. In such instances, due care should preferably be taken to ensure that the outermost pad or track receives sufficient power for electroadhesion to be effected.

Other types of cleaning devices are also envisioned in addition to the foregoing specific embodiments. For example, a rolling device with an embedded motor can be adapted to move on its own, similar to commercially available self-propelled vacuum cleaning robots. A wall climbing robot, for example, can clean a foreign surface as it climbs the surface and possibly does other operations, such as inspection. Flat active electroadhesive cleaning pads similar to those shown in FIGS. 6A-6E can be used as cleaning patches in applications where rolling motion is either unnecessary or undesirable. A significantly large active electroadhesive cleaning pad can be configured to be a removable wallpaper (e.g., transparent, plain colored or decorative) that effectively lines the inside of a room, for example. As dust or pollen and other allergens move around inside the room due to Brownian motion, such particles will preferentially stick to the active electroadhesive cleaning wall paper. Periodically, a user can simply switch off the active electroadhesion and wipe the wallpaper with a separate conventional cleaning device, such as a cloth. Electroadhesion also allows conformability, and lends itself to wearable devices, such as a mask or respirator device or embedded into clothes. In such cases, electroadhesion can act to trap dust on its own, which may be in addition to filters that can be woven into fabrics and/or other materials comprising the mask.

Power for a given active electroadhesive cleaning device may come from a battery, capacitor or other storage device, for example. In some cases, the power can be generated by the motion of the cleaning device itself, similar to what is used in a Van de Graaf generator, for example. In some cases, it may also be possible to generate the required charges from the triboelectric effect of rubbing the cleaning device against the surface of interest, or internally against the body of the cleaning device. For example, such a result can be obtained where an interactive surface in the form on an electroadhesion belt or track is driven forward. Where a given interactive surface is desired to be used in a back and forth motion (e.g., as are most household vacuum cleaners and carpet sweepers), the surface of the electroadhesive track or belt that is in contact with the surface to be cleaned can be kept at a high voltage, while the top surface of the track that is away from the dirty surface can be held at ground potential. This can permit the active electroadhesive cleaning device to clean the target surface regardless of the direction of movement of the electroadhesive track. In such embodiments, the collecting belt or other similar component that collects charges from rotating around a roller or other similar component formed from a dissimilar material can be considered an input component for the device or system.

As yet another possible feature, an added ability to sense dust, dirt or other foreign particles or items can be helpful. Such sensing can be accomplished by way of measuring the capacitance and/or resistance at one or more locations on the interactive or electrode surface. Changes in the capacitance and/or resistance can indicate that there is too much dirt or particulate matter on the interactive surface. Such a sensed result can be acted upon in a number of ways. An alarm in the form of an indicator light or sound can let the user know that the surface may need to be cleaned or replaced. Alternatively, or in addition, sensing an increased amount of dirt or particulate matter can result in an automated response to repel the dirt, such as by way of a reversed polarity burst or pulse. The level or repetition of the burst or pulse can be increased as may be desirable in response to a sensed increase in dirtiness on the surface. In addition, sensing can be used to discriminate between different types of materials and/or different sizes of materials to be cleaned or manipulated.

Figure 10C:
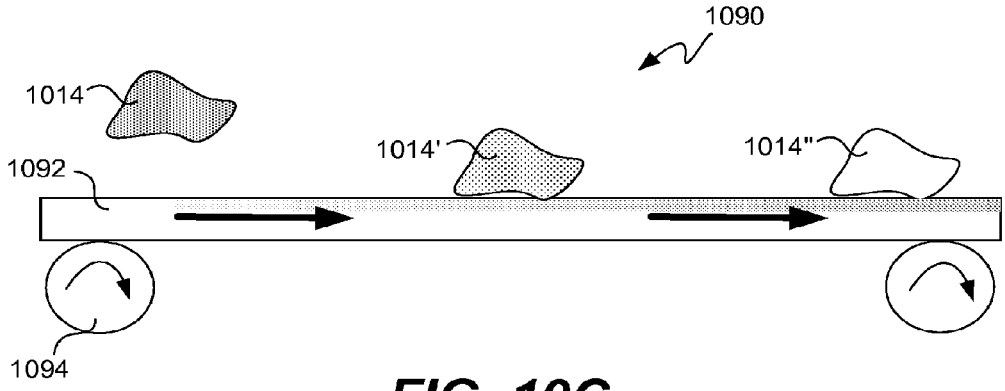
FIG. 10C illustrates in side elevation view an exemplary conveyor belt based active electroadhesive cleaning system according to one embodiment of the present invention.

Moving next to FIG. 10C a separate exemplary conveyor belt based active electroadhesive cleaning system according to one embodiment of the present invention is illustrated in side elevation view. This depicted active electroadhesive cleaning system 1090 can include an electroadhesively charged conveyor belt 1092 that processes along a plurality of rollers 1094 or other similar components. This conveyor belt 1092 can include an upper surface that is effectively the interactive surface of the system, as well as a plurality of electrodes (not shown) that can be patterned beneath or otherwise proximate to the belt.

As a given foreign object 1014 that is covered in dirt or dust encounters the electroadhesively charged belt 1092, this foreign object is cleaned through an electroadhesive process as it jumbles on and travel along the belt. Such a cleaning can be effected by way of, for example, a pulsed electroadhesive force that is applied all along the belt as the foreign object travels therealong. While foreign object 1014 is significantly dirty or dusty when it first encounters the electroadhesively charged conveyor belt 1092 at the left side as shown, some of the dirt or dust is removed from the foreign object 1014' at a partial location along the belt. In some embodiments, all or a substantial portion of the dirt or dust is removed from foreign object 1014" by the time it reaches the end of travel along belt 1092. Consequently, the belt 1092 itself gets increasingly dirty from the start to the finish of the cleaning process. The reverse process can also be useful in some alternative embodiments, such as where dust is collected by a belt for purposes of coating an object that travels along it. One example of such a coating process could be to coat glass sheets with powder, such that the glass sheets do not then stick to each other significantly when stacked.

Methods

Figure 11:
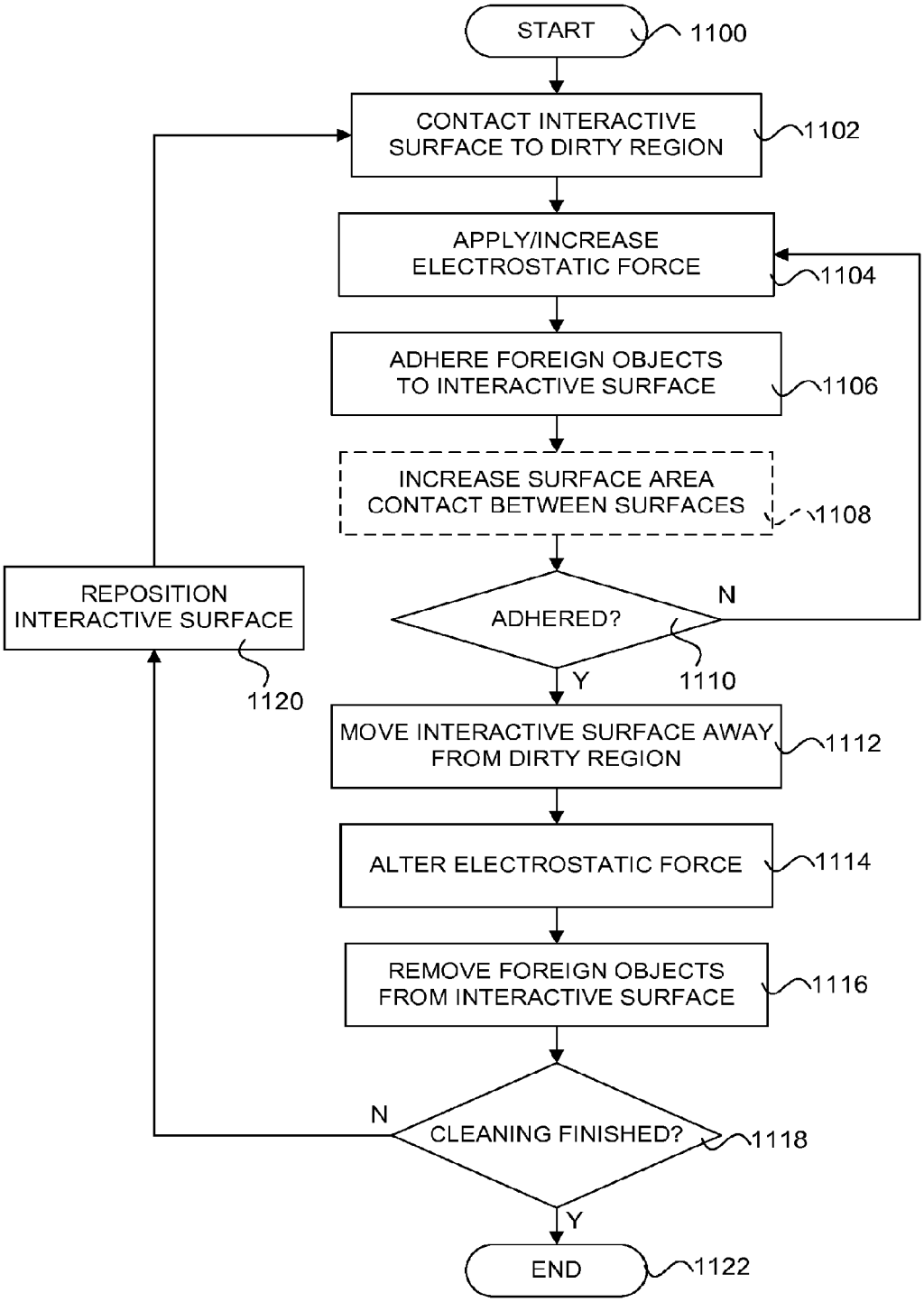
FIG. 11 provides a flowchart of an exemplary method of cleaning a plurality of foreign objects according to one embodiment of the present invention.

Although a wide variety of applications involving cleaning, dusting and otherwise manipulating particulate matter and foreign objects using electroadhesion can be envisioned, one basic method is provided here as an example. Turning next to FIG. 11, a flowchart of an exemplary method of physically cleaning a plurality of foreign objects is provided. In particular, such a method can involve using or operating an active electroadhesive device or system, such as any of the various cleaning pad, track based or conveyor belt based components, devices and systems described above. It will be readily appreciated that not every method step set forth in this flowchart is always necessary, and that further steps not set forth herein may also be included. For example, neither increasing the surface area contact nor checking whether foreign objects are adhered is necessary in all embodiments. Furthermore, the exact order of steps may be altered as desired for various applications.

Beginning with a start step 1100, an interactive surface is contacted to a dirty region or surface to be cleaned at process step 1102. An electrostatic adhesion voltage is then applied or increased at process step 1104, after which the foreign particles or objects to be cleaned are adhered to the interactive surface at process step 1106. At a following optional process step 1108, the surface area contact can be increased between the interactive surface and each of the plurality of foreign objects.

At a subsequent decision step 1110, an inquiry is made as to whether or not the foreign objects are suitably adhered to the interactive surface. Detection of such status can be accomplished by way of one or more sensors, for example. In the event that the foreign objects are not suitably adhered, then the method reverts to process step 1104, where the electrostatic force can be reapplied or increased. In the event that the foreign objects are suitably adhered at step 1110, then the method proceeds to process step 1112, where the interactive surface is moved away from the dirty surface or region.

At the next process step 1114, the electrostatic force can then be altered, such as by adjusting the input voltage. Such altering can be a reduction or complete removal of the electrostatic force, or can even involve a reverse polarity pulse or application of repelling force. At the following process step 1116, the foreign objects can then be removed from the interactive surface, preferably such that the interactive surface can then be used again or more often to clean or remove other foreign objects. At a subsequent decision step 1118, an inquiry is then made as to whether the cleaning is finished. If not, then the method continues to process step 1120, where the interactive surface can be repositioned with respect to the dirty region or surface. The method then reverts to process step 1102, upon which the entire method is repeated.

In the event that cleaning is finished at step 1118, however, then the method proceeds to finish at and end step 1122. Further steps not depicted can include, for example, sensing the size and/or amount of particles or foreign objects that are adhered to the interactive surface, and providing added force or steps with respect to removing such items when they are sensed. Other steps can include providing and/or detecting an input with respect to the size of foreign objects to be cleaned, as well as an actuation within a patterned electrode set that adjusts the size of foreign objects that will be adhered. Other undisclosed process steps may also be included, as may be desired.

Figure 12:
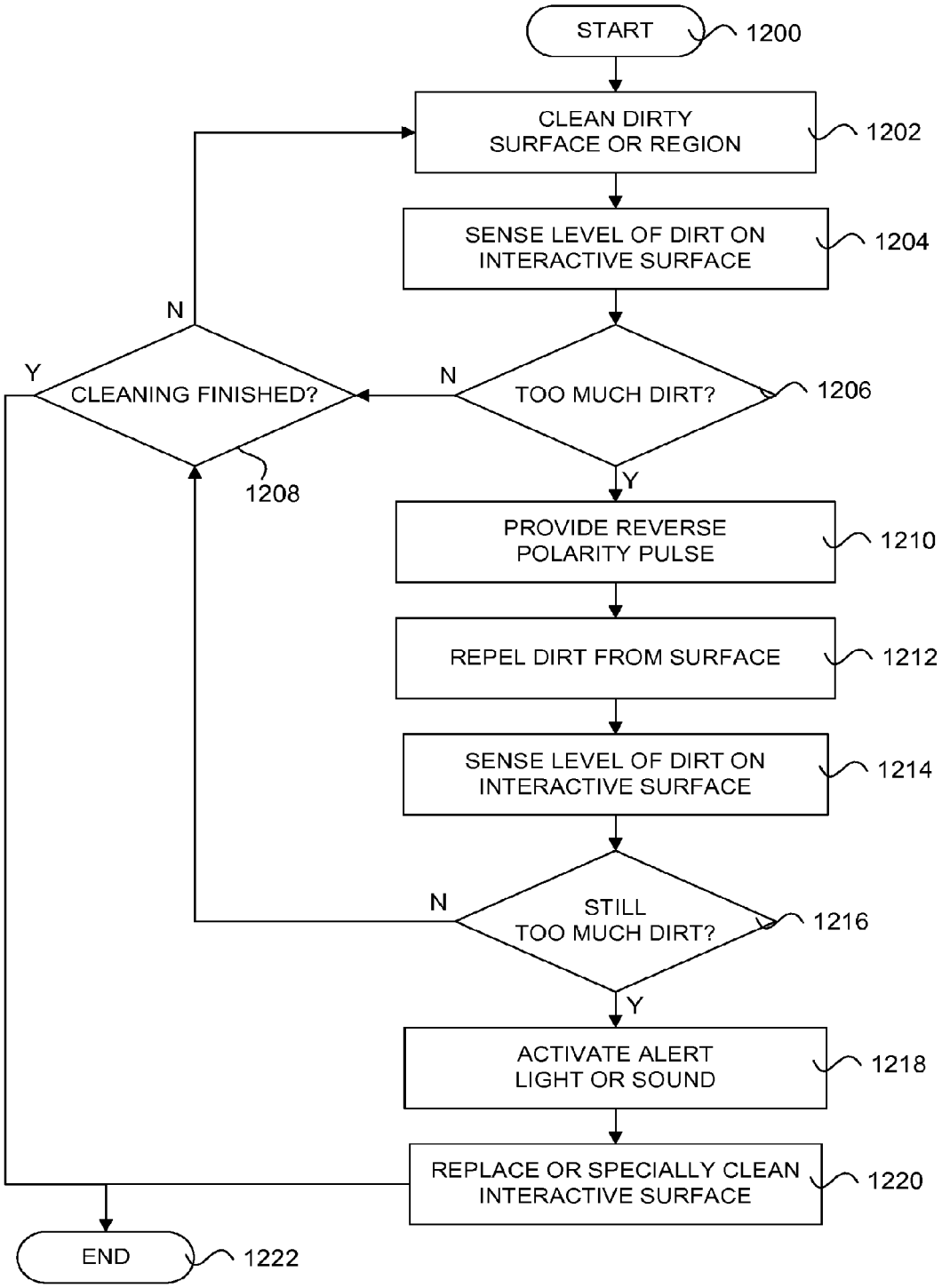
FIG. 12 provides a flowchart of an exemplary method of active electroadhesive cleaning involving reusing an interactive surface according to one embodiment of the present invention.

Referring lastly to FIG. 12, a flowchart of an exemplary method of active electroadhesive cleaning involving reusing an interactive surface is provided. Again, such a method can involve using or operating an active electroadhesive device or system, such as any of the various cleaning pad, track based or conveyor belt based components, devices and systems described above. Again, not every method step set forth is always necessary, further steps not set forth herein may also be included, and the exact order of steps may be altered as desired for various applications.

Beginning with a start step 1200, a dirty surface or region is cleaned at process step 1202. Such a cleaning process can be identical or substantially similar to that which is set forth above in FIG. 11, for example. At a subsequent process step 1204, the level or amount of dirt on the interactive surface can be sensed. Again, this can be accomplished by way of one or more sensors that measure the capacitance or resistance of the interactive surface at one or more select locations. At a following decision step 1206, an inquiry is made as to whether there is too much dirt or other foreign objects adhered to the interactive surface. If not, then the method moves on to decision step 1208, where another inquiry is made as to whether or not the cleaning process is finished. If so, then the method ends; however, if not, then the method reverts back to process step 1202 and begins anew.

In the event that there is too much dirt detected at decision step 1206, then the method proceeds to process step 1210, where one or more reverse polarity pulses can be provided. At subsequent process step 1212, dirt and/or other foreign objects are then repelled from the interactive surface, such as a result from the reverse polarity pulse or pulses. At the following process step 1214, the level of dirt or other foreign objects on the interactive surface is again sensed. At a similar subsequent decision step 1216, an inquiry is made as to whether there is still too much dirt or other foreign objects remaining on the interactive surface. If not, then the method can proceed to decision step 1208, with the process from that point already being provided above.

If it is determined at step 1216 that there is still too much dirt, however, then a visible or audio alert or alarm is provided at process step 1218, such as by a light or sound to the user. The interactive surface can then be specially cleaned or even replaced at process step 1220, upon which the method then ends.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Various changes and modifications may be practiced, and it is understood that the invention is not to be limited by the foregoing details, but rather is to be defined by the scope of the claims.

What is claimed is:

1. A cleaning device, comprising:

an interactive surface configured to contact a surface to be cleaned, wherein the surface to be cleaned has particulate matter disposed thereon;

a plurality of oppositely chargeable electrodes arranged in a pattern behind or adjacent to the interactive surface;

a power source configured to apply an electrostatic adhesion voltage to the oppositely chargeable electrodes, wherein the electrostatic adhesion voltage comprises a differential voltage of at least 500 volts between the oppositely chargeable electrodes, wherein the electrostatic adhesion voltage is sufficient to generate an electrostatic attraction force through at least a portion of the interactive surface that causes the particulate matter to adhere to the interactive surface;

a receptacle;

one or more guides; and one or more rollers coupled to the interactive surface, wherein the one or more rollers are configured to move the interactive surface away from the surface to be cleaned while the particulate matter remains adhered thereto and to further move the interactive surface past the one or more guides to remove the particulate matter from the interactive surface, wherein the one or more guides are configured to direct the particulate matter from the interactive surface into the receptacle.

2. The cleaning device of claim 1, further comprising:

a handle, wherein the cleaning device can be moved across the surface to be cleaned via the handle such that the interactive surface moves via the one or more rollers.

3. The cleaning device of claim 1, wherein the one or more guides comprise one or more brushes or rollers.

4. The cleaning device of claim 1, wherein the power source is configured to alter the electrostatic adhesion voltage before the particulate matter is removed from the interactive surface.

5. The cleaning device of claim 1, further comprising:

a user input component configured to receive a user input.

6. The cleaning device of claim 5, wherein the power source is configured to apply the electrostatic adhesion voltage to the oppositely chargeable electrodes in response to the user input.

* * * * *